US009851656B2

(12) United States Patent
Juri et al.

(10) Patent No.: US 9,851,656 B2
(45) Date of Patent: Dec. 26, 2017

(54) DEVELOPING ROLLER, TONER AND IMAGE FORMING APPARATUS

(71) Applicants: Keiichiro Juri, Kanagawa (JP); Makoto Matsushita, Tokyo (JP); Hideaki Yasunaga, Tokyo (JP)

(72) Inventors: Keiichiro Juri, Kanagawa (JP); Makoto Matsushita, Tokyo (JP); Hideaki Yasunaga, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/072,689

(22) Filed: Mar. 17, 2016

(65) Prior Publication Data

US 2016/0274489 A1 Sep. 22, 2016

(30) Foreign Application Priority Data

Mar. 18, 2015 (JP) ..... 2015-054797
Nov. 4, 2015 (JP) ..... 2015-216439

(51) Int. Cl.
*G03G 15/08* (2006.01)
*G03G 21/00* (2006.01)

(52) U.S. Cl.
CPC ..... *G03G 15/0818* (2013.01); *G03G 21/0011* (2013.01)

(58) Field of Classification Search
CPC ..... G03G 9/0819; G03G 9/09725; G03G 15/0808; G03G 15/08; G03G 21/0017; G03G 21/0011; G03G 9/08755
See application file for complete search history.

(56) References Cited

U.S. PATENT DOCUMENTS

2005/0201778 A1* 9/2005 Takada ..... G03G 21/0029 399/159
2006/0204882 A1 9/2006 Nozaki et al.
2006/0275686 A1 12/2006 Kadota et al.
2007/0059625 A1 3/2007 Yamamoto et al.
2007/0122729 A1 5/2007 Katoh et al.
2007/0148568 A1 6/2007 Kadota et al.
2007/0190443 A1 8/2007 Hagi et al.
2007/0207399 A1 9/2007 Kadota et al.
2007/0212630 A1 9/2007 Yasunaga et al.
2007/0217842 A1 9/2007 Kato et al.
2007/0238042 A1 10/2007 Yasunaga et al.
2008/0038656 A1 2/2008 Yasunaga et al.
2008/0063957 A1 3/2008 Murakami et al.
2008/0069598 A1 3/2008 Murakami et al.
2008/0069605 A1 3/2008 Fuwa et al.
2008/0069608 A1 3/2008 Katoh et al.
(Continued)

FOREIGN PATENT DOCUMENTS

JP 11-212354 8/1999
JP 2009-151084 7/2009
JP 2014-146010 8/2014

*Primary Examiner* — Walter L Lindsay, Jr.
*Assistant Examiner* — Jessica L Eley
(74) *Attorney, Agent, or Firm* — Cooper & Dunham LLP

(57) ABSTRACT

A developing roller includes a conductive axis body; a conductive elastic layer overlying the conductive axis body; and a toner bearing layer overlying the conductive elastic layer and having a surface dispersed with particles having an average particle diameter of from 11 nm to 40 nm. The rotary torque is from 2.5 N to 3.5 N.

10 Claims, 5 Drawing Sheets

(56) References Cited

U.S. PATENT DOCUMENTS

2008/0070149 A1 3/2008 Kato et al.
2008/0153018 A1 6/2008 Mikuriya et al.
2008/0159777 A1 7/2008 Fuwa et al.
2008/0175630 A1 7/2008 Yasunaga et al.
2008/0199234 A1 8/2008 Hagi et al.
2008/0226356 A1 9/2008 Yasunaga et al.
2008/0227009 A1 9/2008 Fuwa et al.
2008/0233506 A1 9/2008 Hagi et al.
2008/0279591 A1 11/2008 Yasunaga et al.
2008/0304875 A1 12/2008 Katoh et al.
2009/0041511 A1 2/2009 Fuwa et al.
2009/0052952 A1 2/2009 Katoh et al.
2009/0060540 A1 3/2009 Matsushita et al.
2009/0117481 A1 5/2009 Yasunaga et al.
2009/0169270 A1* 7/2009 Fuwa ..... G03G 9/0819 399/279
2009/0180791 A1 7/2009 Matsushita et al.
2009/0186291 A1 7/2009 Mikuriya et al.
2009/0190949 A1 7/2009 Hamahashi et al.
2009/0238585 A1 9/2009 Hayashi et al.
2009/0279909 A1 11/2009 Matsushita et al.
2009/0324270 A1 12/2009 Yamashita et al.
2010/0009282 A1 1/2010 Katoh et al.
2010/0167196 A1 7/2010 Hagi et al.
2011/0008069 A1 1/2011 Matsushita et al.
2011/0033791 A1* 2/2011 Tokutake ..... G03G 5/0696 430/59.5
2011/0123234 A1* 5/2011 Terai ..... G03G 15/0921 399/273
2011/0217653 A1 9/2011 Izutani et al.
2011/0243616 A1 10/2011 Nakagawa et al.
2011/0249994 A1 10/2011 Matsushita et al.
2012/0237270 A1 9/2012 Juri et al.
2012/0294657 A1 11/2012 Matsushita et al.
2013/0058685 A1 3/2013 Juri et al.
2014/0056623 A1* 2/2014 Ozaki ..... G03G 15/0806 399/285
2014/0212184 A1 7/2014 Juri et al.
2014/0243465 A1 8/2014 Matsushita et al.
2014/0321888 A1 10/2014 Yasunaga et al.
2015/0014602 A1 1/2015 Matsushita et al.
2015/0078777 A1 3/2015 Juri et al.
2015/0078790 A1 3/2015 Ishikawa et al.
2015/0078791 A1 3/2015 Momose et al.
2016/0004191 A1 1/2016 Juri et al.

* cited by examiner

DEVELOPING ROLLER, TONER AND IMAGE FORMING APPARATUS

CROSS-REFERENCE TO RELATED APPLICATIONS

This patent application is based on and claims priority pursuant to 35 U.S.C. §119 to Japanese Patent Applications Nos. 2015-054797 and 2015-216439, filed on Mar. 18, 2015 and Nov. 4, 2015, respectively in the Japan Patent Office, the entire disclosure of which is hereby incorporated by reference herein.

BACKGROUND

1. Technical Field

The present invention relates to a developing roller, a toner and an image forming apparatus.

2. Description of the Related Art

An image forming apparatus using one-component contact developing method provides a toner from a rotating developing roller on the surface of which a toner thin layer is formed to an electrostatic latent on the surface of a photoconductor to form a toner image. It is known that the toner thin layer is formed by a regulation blade (regulation member).

Since the one-component contact developing method strongly frictionize a toner with the regulation blade to charge the toner, a large stress is given to the toner. Therefore, the method is not suitable to a low-temperature fixable toner which is the recent mainstream. Particularly, toner anchorage on the regulation blade and toner filming on the developing roller are likely to be caused. This is partly because a toner is strongly frictionized by the regulation blade and a temperature therearound increases to soften toner components such as a wax (release agent) and a fixing assistant, resulting in adherence thereof to the regulation blade.

This causes adherence of the toner itself, an external additive thereof, etc. to the regulation blade or the developing roller, and the adherence expands due to stress, resulting in the anchorage on the regulation blade and the filming on the developing roller. The anchorage on the regulation blade disturbs passage of a toner through a nip of the regulation blade, resulting in image void. The filming quicken deterioration in quality of the developing roller as time passes, resulting in lowering of charge quantity, increase of toner consumption due to deterioration of background fouling, and deterioration of solid image followability due to lowering of scrapability.

The toner anchorage on the regulation blade and the toner filming on the developing roller have a trade-off relation, and it has been difficult for conventional developing rollers to solve the two problems at the same time. Developing spheric polymerization toners having good low-temperature fixability, and further high-speed printing and long-life image forming systems noticeably have these problems.

SUMMARY

A developing roller includes a conductive axis body; a conductive elastic layer overlying the conductive axis body; and a toner bearing layer overlying the conductive elastic layer and having a surface dispersed with particles having an average particle diameter of from 11 nm to 40 nm. The rotary torque is from 2.5 N to 3.5 N.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
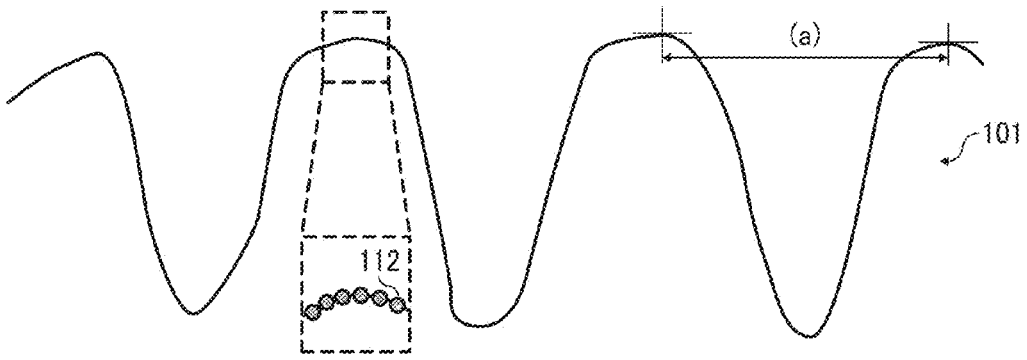
FIG. 1 is an amplified schematic view illustrating an embodiment of the developing roller of the present invention.

Accordingly, one object of the present invention is to provide a developing roller capable of suppressing anchorage on the regulation blade and filming on the developing roller even in a high-speed printing and long-life image forming system using a low-temperature fixable toner.

Another object of the present invention is to provide a toner used for the developing roller.

A further object of the present invention is to provide an image forming apparatus using the developing roller.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The present invention provides a developing roller having a rotary torque of from 2.5 N to 3.5 N, including a conductive axis body; a conductive elastic layer overlying the conductive axis body; and a toner bearing layer overlying the conductive elastic layer, wherein particles having an average particle diameter of from 11 nm to 40 nm are dispersed on the surface of the toner bearing layer. The rotary torque in the present invention is determined by the method mentioned later.

As mentioned above, the toner anchorage on the regulation blade and the toner filming on the developing roller have a trade-off relation, and it has been difficult for conventional developing rollers to solve the two problems at the same time. The present inventors found that filming resistance is improved when a rotary torque of the developing roller is decreased (lowered) and regulation blade anchorage is improved when the rotary torque of the developing roller is increased (raised).

The rotary torque of from 2.5 N to 3.5 N does not cause regulation blade anchorage, lessens filming, does not worsen background fouling, and does not lower solid image followability.

In a high-speed printing and long-life image forming system using a spherical low-temperature fixable polymerization toner, a developing roller having a surface roughness with particles having a particle diameter of tens of μm is difficult to use because the particles are worn or released as time passes.

The present inventors found a developing roller having a combination of a surface profile keeping scrapability and assuring releasability, and a surface layer material having high hardness and releasability can suppress regulation blade anchorage and filming. Hereinafter, details are explained.

(Developing Roller)

The developing roller of the present invention includes a conductive axis body; a conductive elastic layer overlying the conductive axis body; and a toner bearing layer overlying the conductive elastic layer. Hereinafter, details of each of the compositions are explained.

<Conductive Axis Body>

The shape, structure, size and materials of the conductive axis body are not particularly limited and can be appropriately selected depending on the intended purpose. The shape may be a columnar solid body or a hollow cylindrical body. The structure may be single-layered or multilayered. The size can be appropriately selected depending on the size of the developing roller. The conductive axis body preferably has a volume resistivity not greater than $10^{10}$ Ω·cm.

The materials of the conductive axis body include (1) a metallic substrate formed of iron, aluminum, stainless steel, brass, etc., (2) a substrate formed of a core body which is a thermoplastic resin or a thermosetting resin plated with a metallic film, (3) a substrate formed of a core body which is a thermoplastic resin or a thermosetting resin vapor-deposited with a metallic film, (4) a substrate formed in a body with a resin composition including a thermoplastic resin or a thermosetting resin blended with carbon black or a metallic powder as a conductive agent, etc.

<Conductive Elastic Layer>

The conductive elastic layer includes an elastic material and a conductive agent, and other components when necessary. The conductive elastic layer preferably has a volume resistivity not greater than $10^{10}$ Ω·cm.

The elastic material is not particularly limited and can be appropriately selected depending on the intended purpose. Specific examples thereof include rubbers or elastomers such as silicone rubbers, ethylene-propylene-butadiene rubbers, polyurethane rubbers, chloroprene rubbers, natural rubbers, butyl rubbers, polyisoprene rubbers, polybutadiene rubbers, styrene-butadiene rubbers, nitrile rubbers, ethylene-propylene rubbers, acrylic rubbers, epichlorohydrin rubbers or their mixtures. These can be used alone or in combination. Among these, epichlorohydrin rubbers are preferably used because of having suitable hardness.

The conductive agent is not particularly limited and can be appropriately selected depending on the intended purpose, e.g., an ionic conductive agent or an electron conductive agent can be used.

Specific examples of ionic conductivizers include, but are not limited to, perchlorates such as tetraethylammonium, tetrabutylammonium, dodecyltrimethylammonium, hexadecyltrimethylammonium, benzyltrimethylammonium, modified fatty acid dimethylethylammonium lauryl trimethyl ammonium chloride; ammonium salts such as chlorates, hydrochlorides, bromates, iodates, fluoroboric acid salts, hydrosulfates, ethyl hydrosulfates, carboxylates and sulfonates; alkali metals such as lithium, sodium, kalium, calcium and magnesium; and chlorates, hydrochlorides, bromates, iodates, fluoroboric acid salts, hydrosulfates, ethyl hydrosulfates, carboxylates and sulfonates of alkaline-earth metals.

Specific examples of the electron conductive agent include conductive carbons such as ketjen black and acetylene black; carbons for rubber such as SAF, ISAF, HAF, FEF, GPF, SRF, FT and MT; oxidatively-treated carbons for ink; pyrolyzed carbons; natural graphite; artificial graphite; metals and metal oxides such as tin oxide, titanium oxide, zinc oxide, nickel, copper, silver and germanium. These can be used alone or in combination.

The content of the ionic conductive agent is preferably from 0.01 to 5 parts by weight, and more preferably from 0.05 to 2 parts by weight per 100 parts by weight of the elastic material. The content of the electron conductive agent is preferably from 1 to 50 parts by weight, and more preferably from 5 to 40 parts by weight per 100 parts by weight of the elastic material.

The other components include a softener, a vulcanizing agent, a processing aid, an antioxidant, a filler, a reinforcement agent, etc.

The conductive elastic layer preferably has an average thickness of from 1 to 10 mm.

<Toner Bearing Layer>

As mentioned above, in the present invention, it is essential to control the control a surface profile of the developing roller and a surface layer material. A combination of the surface profile keeping scrapability and assuring releasability and the surface layer material having high hardness and releasability can suppress regulation blade anchorage and filming.

In the present invention, the developing roller has a rotary torque of from 2.5 N to 3.5 N.

The rotary torque of from 2.5 N to 3.5 N does not cause regulation blade anchorage, lessens filming, does not worsen background fouling, and does not lower solid image followability. The surface profile and material are explained.

—Surface Profile—

A specific surface profile is effective to suppress regulation blade anchorage and filming. FIG. 1 is an amplified schematic view illustrating a surface profile of the developing roller. The surface profile of the developing roller is, i.e. a surface profile of the toner bearing layer.

A distance ((a) in FIG. 1) between convexities adjacent to each other on the surface of the developing roller is preferably less than the size of one toner (e.g., 5 to 6 μm). Namely, so thin grooves as not to include even one toner are preferably graved on the surface of the developing roller. This suppress filming over the developing roller while keeping scrapability.

In the present invention, it is essential that particles having an average particle diameter of from 11 nm to 40 nm are dispersed on the surface of the toner bearing layer. The particles aggregate and the aggregates are finely dispersed on the surface of the developing roller. Toner components are difficult to adhere dues to microscopic convexities and concavities formed thereby, and filming over the developing roller is suppressed. When the average particle diameter of the particles are out of the above range, desired microscopic convexities and concavities are not formed, resulting in regulation blade anchorage, filming and deterioration of solid image followability. The average particle diameter of the particles is preferably from 12 nm to 40 nm. In the present invention, the average particle diameter is an average of 50 pieces of the particles observed by a scanning electron microscope (SEM) S-4800 from Hitachi, Ltd. of 100,000 magnifications. A skewness Rsk of the surface of the toner bearing layer in a longitudinal (axial) direction is preferably from −0.6 to −0.3. When Rsk is less than 0, a hill of a roughness curve is larger than a valley thereof. Rsk of from −0.6 to −0.3 improves toner scrapability.

An example of methods of determining roughness skewness Rsk is explained. A linear roughness of the surface of the developing roller in the longitudinal direction by a laser microscope LEXT OLK4100 from OLYMPUS Corp. with an objective lens of 50 magnifications in a roughness measurement mode. Preferably, points 4 cm from both ends of the rubber of the roller and the center thereof, i.e., 3 points are rotated by 90° each, totally 12 points are measured and averaged.

A gap between convexities adjacent to each other on the surface of the toner bearing layer is preferably from 1 to 3 μm. This prevents a toner from being captured in concavities on the developing roller to suppress filming.

An example of methods of determining the gap between convexities adjacent to each other on the surface of the toner bearing layer is explained. The surface of the developing roller is observed by a laser microscope LEXT OLK4100 from OLYMPUS Corp. with an objective lens of 100 magnifications. A gap between convexities adjacent to each other is determined from a profile of the surface of the developing roller in the longitudinal direction. Preferably, points 4 cm from both ends of the rubber of the roller and the center thereof, i.e., 3 points are rotated by 90° each, totally 12 points are measured and averaged.

—Surface Layer Material—

In addition to the above surface profile, the toner bearing layer (surface layer) includes at least the above particles having an average particle diameter of from 11 nm to 40 nm. The toner bearing layer preferably includes a polymer of a polyisocyanate prepolymer and an alternating copolymer of fluoroethylene and vinylether. The toner bearing layer further includes other materials such as conductive materials when necessary.

The particles include organic filler or inorganic fillers. Specific examples of organic fillers include powders of fluorocarbon resins such as polytetrafluoroethylene, silicone resin powders and a-carbon powders. Specific examples of inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin; metal fluorides such as tin fluoride, potassium fluoride and aluminum fluoride; potassium titanate; boron nitride, etc.

Among these, hydrophobized silica, titanium oxide and aluminum oxide are preferably used. These may be used alone or in combination. In addition, marketed products thereof can be used.

The toner bearing layer (solid content) preferably includes the particles in an amount of from 5% by weight to 50% by weight, and more preferably from 10% by weigh to 40% by weight.

The polyisocyanate prepolymer preferably includes polyisocyanate having two or more isocyanate (NCO) groups.

Specific examples of the polyisocyanate compound include, but are not limited to, methylene diphenyl diisocyanate (MDI), tolylenediisocyanate (TDI), xylylenediisocyanate (XDI), diphenylmethanediisocyanate, triphenylmethanetriisocyanate, naphthylene 1,5-diisocyanate (NDI), tetramethylxylylenediisocyanate (TMXDI), isophorondiisocyanate (IPDI), polyphenylmethanepolyisocyanate, modified hydrogenated xylylenediisocyanate (H-XDI), hydrogenated xylylene diisocyanate (H6XDI), dicyclo hexyl methane diisocyanate (H12MDI), hexamethylenediisocyanate (HDI), dimer acid diisocyanate (DDI), norbomenediisocyanate (NBDI), trimethylhexamethylenediisocyanate (TMDI), their adducts and isocyanurates. These may be used alone or in combination.

Among these, TDI, HDI or their isocyanurates are preferably used in terms of having comparatively a low reactive residual isocyanate and an enough pot life. Isocyanurates of HDI is more preferably used.

Marketed isocyanurates such as a HDI isocyanurate D170N and TDI isocyanurate D262 from Mitsui Chemicals, Inc. can be used.

Next, the alternating copolymer of fluoroethylene and vinylether (hereinafter referred to as fluorine polyol) is explained. The copolymer of fluoroethylene and vinylether may be a random copolymer, but is preferably is an alternating copolymer. A molar ratio and a molecular weight thereof are not particularly limited.

Marketed fluorine polyol such as Lumiflon from Asahi Glass Co., Ltd. and Fluonate from DIC Corp. can be used. These may be used alone or in combination.

A crosslinked product between isocyanate and fluorine polyol, including NCO groups of isocyanate more than OH groups of polyol, is preferably used. This promotes crosslinking between isocyanates to obtain a hard and highly releasable surface layer material. A molar ratio of isocyanate group to hydroxyl group (NCO/OH) is preferably from 90 to 300.

Specific examples of the conductive agent include, but are not limited to, conductive carbons such as ketjen black EC and acetylene black; carbons for rubber such as SAF, ISAF, HAF, FEF, GPF, SRF, FT and MT; oxidatively-treated carbons for ink; pyrolyzed carbons; metals and metal oxides such as indium-doped tin oxide (ITO), tin oxide, titanium oxide, zinc oxide, copper, silver and germanium; and conductive polymers such as polyaniline, polypyrrole and polyacetylene. These can be used alone or in combination.

The toner bearing layer (solid content) preferably includes the conductive agent in an amount of from 1 to 50 parts by weight, and more preferably from 5 to 40 parts by weight.

The other components include a solvent, softener, a processing aid, an antioxidant, a filler, a reinforcement agent, a lubricant, etc.

Specific examples of the solvent include, but are not limited to, ketone solvents such as acetone, methyl ethyl ketone and cyclohexanone; aromatic hydrocarbon solvents such as toluene and xylene; aliphatic hydrocarbon solvents such as hexane; alicyclic hydrocarbon solvents such as cyclohexane; ester solvents such as ethyl acetate and butyl acetate; ether solvents such as isopropyl ether and tetrahydrofuran; amide solvents such as dimethylformamide; halogenated hydrocarbon solvents such as chloroform dichloroethane; and their mixed solvents.

The toner bearing layer is formed by, e.g., dissolving or dispersing the toner bearing layer materials in a solvent to prepare a coating liquid; applying the liquid on the conductive elastic layer by a dip coating method, a roll coater method, a doctor blade method or a spray method; and drying the liquid at room temperature or a high temperature of from about 50° C. to 170° C. to be cured.

The toner bearing layer preferably has an average thickness of from 1 to 100 μm, and more preferably from 5 to 30 μm.

—Method of Measuring Rotary Torque—

Figure 2:
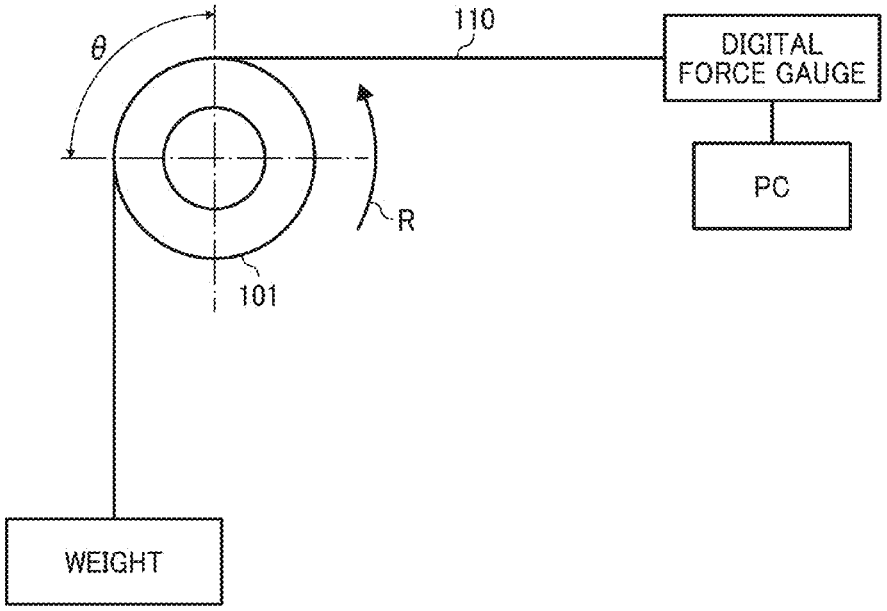
FIG. 2 is a schematic view for explaining a method of measuring a rotary torque.

Next, a method of measuring rotary torque of the developing roller in the present invention is explained, referring to FIG. 2. A PET film is hung on the developing roller as shown in FIG. 2, and one end of the PET film is horizontally attached to a digital force gauge and the other end is attached to a weight of 50 g. The PET film is contacted to the surface of the developing roller at a section view of 90° perpendicular to the axial direction, and the developing roller is rotated at 180 rpm to see a value of the digital force gauge. The digital force gauge is adjusted to have a value of 0 when neither the PET film nor the weight is attached thereto.

When the value of the digital force gauge while the PET film and the weight are attached thereto becomes stable, the developing roller is rotated anticlockwise at 180 rpm in a direction indicated by an arrow R to frictionize the PET film. Then, a friction force between the developing roller and the PET film is measured by the digital force gauge. Analog output values therefrom are subjected to sampling at a rate of 100 points/sec, and an average value of sampled 1,000 points data is produced from a computer, which is determined as a rotary torque in the present invention.

(Toner)

Hereinafter, a toner used for the developing roller of the present invention is explained. The toner of the present invention includes at least a core particle including at least a binder resin, a colorant and a release; and a resin particle adhering to the core particle.

<Binder Resin>

The binder resin is not particularly limited as long as it is soluble in an organic solvent, and conventional resins can be appropriately selected. Specific examples thereof include, but are not limited to, vinyl polymers formed of styrene monomers, acrylic monomers, methacrylic monomers, etc.; copolymers of these monomers or two or more of these monomers; polyester polymers; polyol resins; phenol resins; silicone resins; polyurethane resins; polyamide resins; furan resins; epoxy resins; xylene resins; terpene resins; chroma indene resins; polycarbonate resins; and petroleum resins.

Specific examples of the styrene monomers include, but are not limited to, styrenes such as o-methylstyrene, m-methylstyrene, p-methylstyrene, p-phenylstyrene, p-ethylstyrene, 2, 4-dimethylstyrene, p-n-amyl styrene, p-tert-butyl styrene, p-n-hexylstyrene, p-n-octylstyrene, p-n-nonylstyrene, p-n-decylstyrene, p-n-dodecylstyrene, p-methoxystyrene, p-chlorostyrene, 3, 4-dichlorostyrene, m-nitrostyrene, o-nitrostyrene, p-nitro or their derivatives.

Specific examples of the acrylic monomers include, but are not limited to, acrylic acids and esters of acrylic acids. Specific examples of the esters of acrylic acids include, but are not limited to, methylacrylate, ethylacrylate, propylacrylate, n-butylacrylate, isobutylacrylate, n-octylacrylate, n-dodecylacrylate, 2-ethylhexylacrylate, stearylacrylate, 2-chlorethylacrylate and phenylacrylate.

Specific examples of the methacrylic monomers include, but are not limited to, methacrylic acids and esters of methacrylic acids. Specific examples of the esters of methacrylic acids include, but are not limited to, methylmethacrylate, ethylmethacrylate, propylmethacrylate, n-butylmethacrylate, isobutylmethacrylate, n-octylmethacrylate, n-dodecylmethacrylate, 2-ethylhexylmethacrylate, stearylmethacrylate, phenylmethacrylate, dimethyl methacrylate aminoethyl and diethyl methacrylate aminoethyl.

Specific examples of the other monomers forming the vinyl polymers or copolymers include, but are not limited to, the following (1) to (18).

(1) Monoolefins such as ethylene, propylene, butylene and isobutylene.

(2) Polyenes such as butadiene and isoprene.

(3) Halogenated vinyls such as vinylchloride, vinylidenechloride, vinylbromide and vinylfluoride.

(4) Vinylesters such as vinylacetate, vinylpropionate and vinyl benzoate.

(5) Vinylethers such as vinylmethylether, vinylethylether and vinylisobutylether.

(6) Vinylketones such as vinylmethylketone, vinylhexylketone and methyl isopropenylketone.

(7) N-vinyl compounds such as N-vinylpyrrole, N-vinylcarbazole, N-vinylindole and N-vinylpyrrolidone.

(8) Vinylnaphthalenes.

(9) Acrylic or methacrylic acid derivatives such as acrylonitrile, methacrylonitrile and acrylamide.

(10) Unsaturated dibasic acids such as maleic acid, citraconic acid, itaconic acid, alkenyl succinic acid, fumaric acid and mesaconic acid.

(11) Unsaturated dibasic acid anhydrides such as maleic acid anhydride, citraconic acid anhydride, itaconic acid anhydride and alkenyl succinic acid anhydride.

(12) Unsaturated dibasic acid monoesters such as monomethyl ester maleate, monoethyl ester maleate, monobutyl ester maleate, monomethyl ester citraconate, monoethyl ester citraconate, monobutyl ester citraconate, monomethyl ester itaconate, monomethyl ester alkenyl succinate, monomethyl ester fumarate and monomethyl ester mesaconate.

(13) Unsaturated dibasic acid esters such as dimethyl maleate and dimethyl fumarate.

(14) α, β-unsaturated acid such as crotonic acid and cinnamic acid.

(15) α, β-unsaturated acid anhydrides such as crotonic acid anhydride and cinnamic acid anhydride.

(16) Monomers having a carboxyl group such as anhydrides of the α, β-unsaturated acid and lower fatty acid, alkenyl malonate, alkenyl glutarate, alkenyl adipate and their acid anhydrides and monoesters.

(17) Hydroxyalkyl ester acrylate or methacrylate such as 2-hydroxyethylacrylate, 2-hydroxyethylmethacrylate and 2-hydroxypropylmethacrylate.

(18) Monomers having a hydroxyl group such as 4-(1-hydroxy-1-methylbutyl)styrene and 4-(1-hydroxy-1-methylhexyl)styrene.

The vinyl polymers or copolymers of the binder resin in the toner of the present invention may have a structure crosslinked with a crosslinker having two or more vinyl groups.

Specific examples of the crosslinker include, but are not limited to, aromatic divinyl compounds such as divinylbenzene, divinyl naphthalene; diacrylate compounds bonded with alkyl chains such as ethyleneglycol diacrylate, 1, 3-butylene glycol diacrylate, 1, 4-butanediol diacrylate, 1, 5-pentanediol diacrylate, 1, 6-hexanediol diacrylate, neopentylglycol diacrylate and these compounds except the acrylates are replaced with methacrylates; and diacrylate compounds bonded with an alkyl chain including an ether bond such as diethyleneglycol diacrylate, avian ethyleneglycol diacrylate, tetraethyleneglycol diacrylate, polyethylene glycol #400 diacrylate, polyethylene glycol #600 diacrylate, dipropylene glycol diacrylate and these compounds except the acrylates are replaced with methacrylates.

In addition, diacrylate and dimethacrylate compounds bonded with a chain including an aromatic group and an ether bond can also be used.

In addition, the crosslinker includes polyester diacrylates such as MANDA from Nippon Kayaku Co., Ltd.

Further, the crosslinker includes multifunctional crosslinkers such as pentaerythritol triacrylate, trimethylolethane triacrylate, trimethylol propane triacrylate, tetramethylol methane tetraacrylate, oligoester acrylate, these compounds except the acrylates are replaced with methacrylates, triallyl cyanurate and triallyltrimellitate.

In the present invention, an acid value of the binder resin component of the toner composition is measured by the following method, basically according to JIS K-0070.

(1) Additives except for the binder resin (polymer components) are previously removed or acid values and contents of components except for the binder resin and the cross-linked binder resin are previously measured. Zero point five (0.5) to 2.0 g of the pulverized sample were precisely measured, and a weight of the polymer component is Wg. For example, when an acid value of the binder resin of a toner is measured by calculation after an acid value and a content of the colorant, the magnetic material, etc. are measured.

(2) The sample is placed in a 300 ml beaker and dissolved in 150 ml of a mixed liquid including toluene and ethanol (volume ratio 4/1).

(3) Titration is performed by a potentiometric titrator with an ethanol solution of 0.1 mol/l KOH.

(4) An amount of the KOH solution used then is S (ml), the blank is measured at the same time, an amount of the KOH solution used then is B (ml), and the acid value is measured by the following formula (C). f is a factor of KOH.

$$\text{Acid value (mg KOH/g)}=[(S-B)\times f\times 5.61]/W \quad \text{(C)}$$

The binder resin and compositions including the binder resin of the toner preferably have a glass transition temperature (Tg) of from 40° C. to 80° C. in terms of toner preservability. When lower than 40° C., the toner may deteriorate. When higher than 80° C., the toner may deteriorate in fixability.

An example of methods of measuring a glass transition temperature is explained. For example, using TG-DS system TAS-100 from Rigaku Corp., about 10 mg of the sample is placed in an aluminum sample container, which is loaded on a holder unit, and which is set in an electric oven. Next, after the sample is heated to 150° C. at 10° C./min from room temperature, it was left for 10 min at 150° C., it is cooled to room temperature and left for 10 min, and it is heated to 150° C. at 10° C./min again in a nitrogen atmosphere to make DSC measurement. The glass transition temperature (Tg) is calculated from a contact point between a tangential line of an endothermic curve near the glass transition temperature (Tg) and the base line.

The binder resin may be selected according to an organic solvent and a release agent. When a release agent having high solubility in an organic solvent is used, a softening point of the toner may lower. In that case, a weight-average molecular weight of the binder resin is increased to raise a softening point of the binder resin for effectively keeping hot offset resistance.

<Colorant>

Specific examples of the colorant include, but are not limited to, carbon black, nigrosin dye, iron black, naphthol yellow S, Hansa yellow (10G, 5G, G), cadmium yellow, yellow iron oxide, loess, chrome yellow, titanium yellow, poly azo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, anthracene yellow BGL, isoindolinone yellow, Indian red, red lead, lead vermilion, cadmium red, cadmium mercury red, antimony vermilion, permanent red 4R, para red, fire red, Para chlor orthonitro aniline red, re-sole fast scarlet G, brilliant fast scarlet, brilliant carmine BS, permanent red (F2R, F4R, FRL, FRLL, F4RH), fast scarlet VD, Kan Bell fast Rubin B, brilliant scarlet G, re-sole Rubin GX, permanent red F5R, brilliant carmine 6B, pigment scarlet 3B, Bordeaux 5B, toluidine Marron, permanent Bordeaux F2K, helio Bordeaux BL, Bordeaux 10B, Bon Marron light, Bon Marron medium, an eosin lake, rhodamine lake B, rhodamine lake Y, an alizarin lake, thioindigo red B, thioindigo Marron, oil red, Quinacridone red, pyrazolone red, poly azo red, a chrome vermillion, a benzidine orange, perynone orange, an oil orange, azure blue, cerulean blue, an alkaline blue lake, a peacock blue lake, Victoria blue lake, no metal phthalocyanine blue, phthalocyanine blue, fast sky blue, Indanthrene blue (RS, BC), indigo, sea blue, Berlin blue, anthraquinone blue, fast violet B, a methyl violet lake, cobalt purple, manganese purple, dioxane violet, anthraquinone violet, chrome green, zinc green, chromium oxide, viridian, emerald green, pigment green B, naphthol green B, green gold, an acid green lake, a chrysocolla lake, phthalocyanine green, anthraquinone green, titanium oxide, hydrozincite, lithophone and their mixtures.

The toner preferably includes the colorant in an amount of from 1% to 15% by weight, and more preferably from 3% to 10% by weight.

The colorant can be combined with a resin as a masterbatch.

Specific examples of the resin kneaded with the colorant include, besides the modified and unmodified polyester resin, polymers of styrene and its substituents such as polystyrene, poly-p-chlorostyrene, polyvinyl toluene; styrene-based copolymers such as a styrene-p-chlorostyrene copolymer, a styrene-propylene copolymer, a styrene-vinyl toluene copolymer, a styrene-vinyl naphthalene copolymer, a styrene-acrylic acid methyl copolymer, a styrene-acrylic acid ethyl copolymer, a styrene-acrylic acid butyl copolymer, a styrene-acrylic acid octyl copolymer, a styrene-methyl methacrylate copolymer, a styrene-methacrylic acid ethyl copolymer, a styrene-methacrylic acid butyl copolymer, a styrene-α-chlor methyl methacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleate copolymer; polymethylmethacrylate, polybutylmethacrylate, polyvinyl chloride, polyvinyl acetate, polyethylene, polypropylene, polyester, an epoxy resin, an epoxy polyol resin, polyurethane, polyamide, the polyvinyl butyral, the polyacrylic acid resin, a rosin, a modified rosin, a terpene resin, an aliphatic or alicyclic hydrocarbon resin, an aromatic petroleum resin, chlorinated paraffin, paraffin wax, etc. These can be used alone or in combination.

The masterbatch is obtained by mixing and kneading a resin and a colorant therefor with application of high shearing force.

Then, an organic solvent can be used to increase interaction between the colorant and the resin. In addition, a flushing method in which an aqueous paste of colorant including water is mixed and kneaded with a resin and an organic solvent to transfer the colorant to the resin and the water and the organic solvent are removed can also be used. This method does not need drying because a wet cake of the colorant can be used as it is. A high-shearing disperser such as three-roll mills is preferably used for mixing and kneading. The content of the masterbatch is preferably from 0.1 to 20 parts by weight per 100 parts by weight of the binder resin.

The binder resin for masterbatch is preferably dispersed with the colorant, having an acid value not greater than 30 mg KOH/g and an amine value of from 1 to 100, and more preferably dispersed with the colorant, having an acid value not greater than 20 mg KOH/g and an amine value of from 10 to 50.

When the acid value is not greater than 30 mg KOH/g, the toner does not deteriorate in chargeability in high humidity and a pigment has sufficient dispersibility. When the amine value is of from 1 to 100, a pigment has sufficient dispersibility.

The acid value can be measured by, e.g., the method disclosed in JIS K0070, and the amine value can be measured by, e.g., the method disclosed in JIS K7237.

—Pigment Dispersion—

The colorant may be dispersed in a pigment dispersion to be used as a colorant dispersion.

The pigment dispersant is not particularly limited and can be appropriately selected depending on the intended purpose. The pigment dispersant preferably has high compatibility with a binder resin, and marketed products thereof include AJISPER PB821 and PB822 from Ajinomoto Fine-Techno Co., Inc.; Disperbyk-2001 from BYK-Chemie GmbH; and EFKA-4010 from BASF, etc.

The pigment dispersant preferably has a weight-average molecular weight is preferably from 500 to 100,000 at a maximum value of main peak of styrene conversion weight in gel permeation chromatography. The weight-average molecular weight is more preferably from 3,000 to 100,000, furthermore preferably from 5,000 to 50,000, and most preferably from 5,000 to 30,000 in terms of pigment dispersibility. When less than 500, the polarity is high and the colorant may deteriorate in dispersibility. When greater than 100,000, the pigment dispersant has higher affinity with a solvent and the colorant may deteriorate in dispersibility.

The content of the pigment dispersant is preferably from 1 to 200 parts by weight, and more preferably from 5 to 80 parts by weight per 100 parts by weight of the colorant. When not less than 1 part by weight, dispersibility does not deteriorate. When not greater than 200, the chargeability does not deteriorate.

<Release Agent>

Specific examples of the release agent include, but are not limited to, aliphatic hydrocarbon waxes such as low-molecular-weight polyethylene, low-molecular-weight polypropylene, polyolefin wax, microcrystalline wax, paraffin wax and sasol waxes; oxides of aliphatic hydrocarbon wax or their block copolymers such as oxidized polyethylene wax; plant waxes such as candelilla wax, carnauba wax, tree wax and jojoba wax; animal waxes such as bees wax, lanoline and whale wax; mineral waxes such as okezolite, ceresin and petrolatum; waxes composed primarily of fatty acid esters such as Montan acid ester wax and caster wax; various synthetic ester wax; and synthetic amide wax.

Other examples of the release agent include saturated straight-chain fatty acids such as palmitic acid, stearic acid, Montan acid and other straight-chain alkyl carboxylic acids having a straight-chain alkyl group; unsaturated fatty acid such as piperazine acid, eleostearic acid, parinaric acid, saturated alcohol such as stearyl alcohol, eicosyl alcohol, behenyl alcohol, caunapiru alcohol, seryl alcohol, mecyryl alcohol and other long-chain alkyl alcohols; polyols such as sorbitol; fatty acid amides such as linoleate amide, olefin acid amide and laurate amide; saturated fatty acid bisamide such as methylene biscapric acid amide, ethylene bislaurate amide and hexamethylene bisstearic acid amide; unsaturated fatty acid amide such as ethylene bisoleic acid amide, hexamethylene bisoleic acid amide, N, N'-dioleyl adipic acid amide and N, N'-diolelyl sebacic acid amide; aromatic bisamide such as m-xylene bisstearic acid amide and N, N-distearyl isophthalic acid amide; fatty acid metal salts such as calcium stearate, calcium laurate, zinc stearate and magnesium stearate; aliphatic hydrocarbon waxes waxes grafted with vinyl monomers such as styrene or acrylic acid; partial ester compounds of a fatty acid such as behenic acid monoglyceride and polyol; and methyl ester compounds having a hydroxyl group which is provided by hydrogenating vegetable fat, etc.

These release agents the molecular weights of which are sharpened by a press sweat method, a solvent method, a recrystallization method, a vacuum distillation method, a super critical gas abstraction method or a solution crystallization method; and the release agents a low-molecular-weight solid fatty acid, a low-molecular-weight solid alcohol, a low-molecular-weight solid compound or other impurities are removed from are also preferably used.

The release agent preferably has a melting point not less than 65° C., and more preferably of from 69° C. to 120° C. for balancing fixability and offset resistance. When not less than 65° C., blocking resistance does not deteriorate. When not higher than 120° C., offset resistance is fully exerted.

—Release Agent Amount Abstracted with -n-Hexane—

An amount of release agent abstracted from 1.0 g of a toner with n-hexane is preferably from 10 to 26 mg. This suppresses a regulation blade anchorage, offset in fixing and balances them.

An example of the measuring methods is explained. At room temperature, 7 ml of n-hexane is added to 1 g of a toner, and the mixture is stirred by a roll mill at 120 rpm for 1 min. The solution after stirred is immediately suctioned and filtered. The filtrate is vacuum dried at 40° C. for 30 min, and the quantity of the wax dissolved out from the surface is determined. A membrane filter formed of PTFE having an opening of 1 μm is used as a filter used for the filtration.

<Charge Controlling Agent>

The charge controlling agent is not particularly limited and can appropriately be selected depending on the intended purpose. Specific examples thereof include, but are not limited to, nigrosine dyes, triphenylmethane dyes, chrome-contained metal complex dyes, chelate molybdate pigments, rhodamine dyes, alkoxy amines, quaternary ammonium salts (including quaternary fluorine-modified ammonium salts), alkyl amides, phosphorus or its compounds, tungsten or its compounds, fluorine activators, salicylic acid metal salts, metal salts of salicylic acid derivatives. Specifically, nigrosine dyes Bontron 03, quaternary ammonium salt Bontron P-51, metal-containing azo dye Bontron S-34, metal complex of oxynaphthoic acid E-82, salicylic acid metal complex E-84 and phenolic condensate E-89 (from Orient Chemical Industries Corp.); quaternary ammonium salt molybdenum complexes TP-302 and TP-415 (from Hodogaya Chemical Corp.); quaternary ammonium salt Copy Charge PSY VP2038, triphenylmethane derivative Copy Blue PR, quaternary ammonium salts Copy Charge NEG VP2036 and Copy Charge NX VP434 (from Hoechst AG), LRA-901 and boron complex LR-147 (from Japan Carlit Co., Ltd.); copper phthalocyanine; perylene; Quinacridone; azo pigments; sulfone acid groups; carboxyl groups; polymeric compounds having functional groups such as quaternary ammonium salts; phenolic resins, fluorine compounds, etc. can be used.

The content of the charge controlling agent depends on the binder resin, optional additives and methods of preparing the toner including the dispersion method. The content thereof is preferably from 0.1 to 10 parts by weight, and more preferably from 0.2 to 5 parts by weight per 100 parts by weight of the binder resin. When not greater than 10 parts by weight, the toner does not deteriorate in fixability.

The charge controlling agent is preferably dissolved in an organic solvent in terms of production stability, and may be finely dispersed therein.

<Others>

The toner of the present invention may include other additives such as a fluidity improver and a cleanability improver.

—Fluidity Improver—

The toner of the present invention may include a fluidity improver. The fluidity improver is added to the surface of the toner to improve fluidity thereof.

Specific examples of the fluidity improver include silica fine powders such as wet processed silica and dry processed silica, fine powders of metal oxides such as titanium oxide and alumina, and their processed silica, titanium oxide and alumina, the surfaces of which are treated with a silane coupling agent, a titanium coupling agent, and a silicone oil; fluorinated resin powder such as a vinylidene fluoride fine powder and a polytetrafluoroethylene fine powder. Among these, fine powders of silica, titanium oxide and alumina are preferably used, and silica the surface of which is treated with a silane coupling agent and a silicone oil is more preferably used.

The fluidity improver preferably has an average primary particle diameter of from 0.001 to 2 μm, and more preferably from 0.002 to 0.2 μm.

Preferred silica fine powders include a fine powder prepared by vapor-phase oxidizing a silicon halogen compound, i.e. a dry method silica or a fumed silica.

Specific examples of the marketed silica fine powders include AEROSIL-130, -300, -380, -TT600, -MOX170, -MOX80 and -COK84 from NIPPON AEROSIL CO., LTD.; Ca-O-SiL-M-5, -MS-7, -MS-75, -HS-5 and -EH-5 from Cabot Corp.; Wacker HDK-N20, -V15, -N20E, -T30 and -T40 from WACKER-CHEMIE GmbH; D-C Fine Silica from Dow Corning Corp.; and Fansol from Fransil.

The silica fine powder prepared by vapor-phase oxidizing a silicon halogen compound is preferably hydrophobized. The hydrophobized silica fine powder preferably has a hydrophobicity of from 30 to 80% when measured by a methanol titration method. The silica fine powder is chemically or physically hydrophobized with an organic silicon compound. Preferably, the silica fine powder prepared by vapor-phase oxidization of the silicon halogen compound is treated with the organic silicon compound.

Specific examples of the organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chlorethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethyletoxysilane, trimethyletoxysilane, trimethylmetoxysilane, methyltrietoxysilane, isobutyltrimetoxysilane, dimethyldimethoxysilane, diphenyldiethoxysilane, hexamethyldisiloxane, 1, 3-divinyltetramethyldisiloxane, 1, 3-diphenyltetramethyldisiloxane, dimethylpolysiloxane having 2 to 12 siloxane units and 0 to 1 hydroxyl group bonded with Si at the end unit, etc. Further, silicone oils such as a dimethyl silicone oil can also be used. These can be used alone or in combination.

The fluidity improver preferably has a number-average particle diameter of from 5 to 100 nm, and more preferably from 5 to 50 nm.

The fluidity improver preferably has a specific surface area not less than 30 $m^2/g$, and more preferably from 60 to 400 $m^2/g$ when measured by a BET nitrogen absorption method. When a surface-treated fine powder, the fluidity improver preferably has a specific surface area not less than 20 $m^2/g$, and more preferably from 40 to 300 $m^2/g$.

The fluidity improver is preferably included in a toner in an amount of from 0.03 to 8 parts by weight per 100 parts by weight of the toner.

The cleanability improver improving removability of a toner remaining on an electrostatic latent image bearer or a first transfer medium after the toner is transferred onto a recording paper, etc. is not particularly limited and can appropriately be selected according to the intended purpose. Specific examples thereof include fatty acid metallic salts such as zinc stearate, calcium stearate and stearic acid; and polymer particulate materials prepared by a soap-free emulsifying polymerization method such as a polymethylmethacrylate particulate material and a polystyrene particulate material. The polymer particulate materials comparatively have a narrow particle diameter distribution and preferably have a weight-average particle diameter of from 0.01 to 1 μm.

The fluidity improvers and cleanability improvers are called external additives as well because they adhere to or are fixed on the surface of a toner. A typical powder mixer is used to externally add them to a toner. Specific examples of the mixers include, but are not limited to, V-type Mixer, Rocking Mixer, Loedge Mixer, Nauter Mixer and Henschel Mixer. Hybridizers, Mechanofusion, Q-mixers, etc. are used to fix them on a toner.

<Volume-Average Particle Diameter, Number-Average Particle Diameter and Particle Diameter Distribution of Toner>

The toner of the present invention preferably has a volume-average particle diameter of from 4.00 to 7.00 μm suitable for the surface profile (convex and concave profile) of the developing roller to more suppress filming thereof and produce high-resolution, high-definition and high-quality images. The toner preferably has a particle diameter distribution (volume-average particle diameter/number-average particle diameter) of from 1.14 to 1.23 to produce stable images for long periods.

A volume-average particle diameter (Dv) and a number-average particle diameter (Dn) of the toner are measured by Coulter Multisizer 3 from Beckman Coulter, Inc. Specifically, 0.1 to 5 ml of a surfactant alkylbenzenesulfonate are added to 100 to 150 ml of electrolyte which is an NaCl aqueous solution having a concentration about 1% with a primary sodium chloride using ISOTON-II from Beckman Coulter, Inc. After 2 to 20 mg of a toner are added to the mixture, the mixture is dispersed by an ultrasonic disperser Tetra 150 from Beckman Coulter, Inc. for 1 to 3 min. A particle diameter distribution of the toner is measured with an aperture diameter of 100 μm. The scope of analysis is 2 to 20 μm (2.00 to 19.98 μm).

<Average Circularity>

The toner of the present invention preferably has an average circularity not less than 0.960 to have good cleanability. When less than 0.96, image uniformity when developed may deteriorate, dot or thin line image reproducibility may deteriorate, and further toner transfer efficiency from an electrophotographic photoconductor to an intermediate transferer or from the intermediate transferer to a transfer material may deteriorate. In addition, uneven pile height causes abnormal images such as uneven glossiness, and high-quality images are not produced.

The average circularity is determined by passing a suspension liquid including toner particles through a flat plate imaging detection zone, optically detecting and analyzing the particle image with a CCD camera, and dividing a circumferential length of an equivalent circle having an equivalent area to the particle image with a circumferential length of the actual particle.

A flow-type particle image analyzer FPIA-3000S can measure the average circularity. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

<Preparation Method of Toner>

Preparation methods and materials of the toner of the present invention can be selected from any of methods and materials known in the art without any limitation, as long as the resulting toner satisfies the aforementioned conditions. Examples of the production method thereof include a kneading-pulverization method, and a method in which toner particles are granulated in an aqueous medium, so-called a chemical method.

Examples of the chemical method include a suspension polymerization method, emulsification polymerization method, seed polymerization method, and dispersion polymerization method, all of which use a monomer as a starting material; a dissolution suspension method in which a resin or resin precursor is dissolved in an organic solvent, and the resulting solution is dispersed and/or emulsified in an aqueous medium; a method in which an oil phase composition including a resin precursor having a functional group reactable with an active hydrogen group (prepolymer including a reactive group) is emulsified or dispersed in an aqueous medium including fine resin particles to react a compound including an active hydrogen group with the prepolymer including a reactive group (preparation method (I)); a phase-transfer emulsification method in which water is added to a solution containing a resin or resin precursor, and an appropriate emulsifying agent to proceed phase transfer; and an aggregation method in which resin particles formed in any of the aforementioned methods is dispersed in an aqueous medium, and aggregated by heating and fusing to granulate particles of the predetermined size.

Among them, a toner obtained by the dissolution suspension method, the preparation method (I) or the aggregation method is preferably used because of granulation ability of the crystalline resin (e.g., easiness in control of particle size distribution, and control of particle shape).

These production methods will be specifically explained hereinafter.

The kneading-pulverization method is a method for producing toner base particles, for example, by melting and kneading a toner composition containing at least a colorant, a binder resin and a layered inorganic mineral, pulverizing the resulting kneaded product, and classifying the pulverized particles.

In the melting and kneading, materials of the toner composition are mixed, and the resulting mixture is placed in a melt-kneader to perform melting and kneading. As the melt-kneader, for example, a monoaxial or biaxial continuous kneader, or a batch-type kneader with a roll mill can be used. Preferable examples thereof include a twin screw extruder KTK manufactured by KOBE STEEL, LTD., an extruder TEM manufactured by TOSHIBA MACHINE CO., LTD., a twin screw extruder manufactured by ASADA WORKS CO., LTD., a twin screw extruder PCM manufactured by Ikegai Corp., and a cokneader manufactured by Buss. The melt-kneading is preferably performed under the appropriate conditions so as not to cause scission of molecular chains of the binder resin.

Specifically, the temperature of the melt-kneading is adjusted under taking the softening point of the binder resin as consideration. When the temperature of the melt-kneading is very high compared to the softening point, the scission occurs significantly. When the temperature thereof is very low compared to the softening point, the dispersing may not be progressed. Particularly when the binder resin includes a crystalline resin and an amorphous resin, when the kneading strength is too strong, the temperature increases and the resins are compatible with each other, resulting in lost crystallinity. Therefore, the kneading strength needs decreasing. In that case, the resin is not fully dispersed, resulting in uneven surface potentials of the toner. However, applying a high kneading strength while keeping a low temperature such that the resins are not compatible with each other can suppress uneven surface potentials of the toner even when the binder resin includes a crystalline resin and an amorphous resin.

In the pulverizing, the kneaded product obtained by the kneading is pulverized. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow gap between a mechanically rotating rotor and a stator is preferably used.

The classifying is classifying the pulverized product obtained by the pulverizing into particles having the predetermined particle diameters. The classifying can be performed by removing the fine particles component by means of a cyclone, a decanter, a centrifugal separator, or the like.

After the completion of the pulverizing and the classifying, the classified pulverized product is classified in an air stream by centrifugal force or the like to thereby produce toner base particles having the predetermined particle diameters.

The dissolution suspension method dissolves or disperses toner composition including at least a binder resin or a resin precursor, a colorant and a release agent in an organic solvent to prepare an oil phase composition; and dispersing or emulsifying the oil phase composition in an aqueous medium to prepare toner base particles.

The organic solvent is preferably a volatile solvent having a boiling point less than 100° C. because the solvent can easily be removed afterwards.

Specific examples thereof include ester or ester ether solvents such as ethyl acetate, butyl acetate, methoxy butyl acetate, methyl cellosolve acetate and ethyl cellosolve acetate; ether solvent such as diethyl ether, tetrahydrofuran, dioxane, ethyl cellosolve, butyl cellosolve and propylene glycol monomethyl ether; ketone solvents such as acetone, methyl ethyl ketone, methyl isobutyl ketone, di-n-butyl ketone and cyclohexanone; alcohol solvents such as methanol, ethanol, n-propanol, isopropanol, n-butanol, isobutanol, t-butanol, 2-ethyl hexyl alcohol and benzyl alcohol; and mixed solvents including two or more of these solvents.

In the dissolution suspension method, an emulsifier or a dispersant may be used when the oil phase composition is dispersed or emulsified in an aqueous medium when necessary. Known surfactants and hydrosoluble polymer can be used as the emulsifier or the dispersant. Specific examples of the surfactants include, but are not limited to, an anionic surfactant (alkyl benzene sulfonate, phosphate), a cationic surfactant (quaternary ammonium salt, amine salt), an amphoteric surfactant (carboxylate, ester salt sulfate, sulfonate, phosphate salt) and a non-ionic surfactant (AO addition, polyol). The surfactants may be used alone or in combination.

Specific examples of the hydrosoluble polymers include, but are not limited to, cellulose compounds such as methyl cellulose, ethyl cellulose, hydroxy ethyl cellulose, ethyl hydroxy ethyl cellulose, carboxy methyl cellulose, hydroxy propyl cellulose and their saponified products; gelatin; starch; dextrin; acacia; chitin; chitosan; polyvinylalcohol; polyvinylpyrrolidone; polyethyleneglycol; polyethylene imine; polyacrylamide; polymers including acrylic acid (salt) such as sodium polyacrylate, potassium polyacrylate, ammonium polyacrylate, polyacrylic acid partially-neutralized with sodium hydroxide and sodium acrylate-ester acrylate copolymers; styrene-maleic anhydride (partially-)neutralized with sodium hydroxide; and hydrosoluble polyurethanes such as reaction products between polyethylene glycol or polycaprolactone and polyisocyanate.

As an emulsification or a dispersion auxiliary agent, the organic solvent and the plasticizer can be used together.

The toner is preferably prepared by the method in which an oil phase composition including a resin precursor having a functional group reactable with an active hydrogen group (prepolymer including a reactive group) is emulsified or dispersed in an aqueous medium including fine resin particles to react a compound including an active hydrogen group with the prepolymer including a reactive group (preparation method (I)) to granulate toner base particles.

The fine resin particles can be formed by known polymerization methods. An aqueous dispersion of the fine resin particles is preferably used.

Specific examples of the methods of preparing the aqueous dispersion of the fine resin particles include the following (a) to (h):

(a) polymerizing a vinyl monomer by a polymerization method such as a suspension polymerization method, an emulsion polymerization method, a seed polymerization method or a dispersion polymerization method to directly prepare an aqueous particulate resin dispersion;

(b) dispersing a precursor such as a monomer and an oligomer of polyaddition or polycondensed resins such as a polyester resin, a polyurethane resin and an epoxy resin or its solvent solution in an aqueous medium under the presence of a suitable dispersant to prepare a dispersion, and heating the dispersion and adding a hardener thereto to prepare an aqueous particulate resin dispersion;

(c) dissolving a suitable emulsifier in a precursor such as a monomer and an oligomer of polyaddition or polycondensed resins such as a polyester resin, a polyurethane resin and an epoxy resin or its solvent solution (preferably a liquid and may be heated to liquidate) to prepare a solution, and adding water thereto to phase-inversion emulsify;

(d) pulverizing a resin prepared by a polymerization reaction such as an addition polymerization reaction, a ring-opening polymerization reaction, polyaddition polymerization reaction, an addition condensation reaction and a condensation polymerization reaction with a pulverizer using a mechanical rotator or a jet to prepare a pulverized resin, classifying the pulverized resin to prepare a particulate resin, and dispersing the particulate resin in water under the presence of a suitable dispersant;

(e) dissolving a resin prepared by a polymerization reaction such as an addition polymerization reaction, a ring-opening polymerization reaction, polyaddition polymerization reaction, an addition condensation reaction and a condensation polymerization reaction in a solvent to prepare a resin solution, spraying the resin solution to prepare a particulate resin, and dispersing the particulate resin in water under the presence of a suitable dispersant;

(f) dissolving (while heating) a resin prepared by a polymerization reaction such as an addition polymerization reaction, a ring-opening polymerization reaction, polyaddition polymerization reaction, an addition condensation reaction and a condensation polymerization reaction in a solvent to prepare a resin solution, adding a solvent thereto (or cooling the resin solution) to separate out a particulate resin, removing the solvent from the particulate resin, and dispersing the particulate resin in water under the presence of a suitable dispersant;

(g) dissolving a resin prepared by a polymerization reaction such as an addition polymerization reaction, a ring-opening polymerization reaction, polyaddition polymerization reaction, an addition condensation reaction and a condensation polymerization reaction in a solvent to prepare a resin solution, dispersing the resin solution in an aqueous medium under the presence of a suitable dispersant to prepare a dispersion, and heating or depressurizing the dispersion to remove the solvent therefrom; and (h) dissolving a resin prepared by a polymerization reaction such as an addition polymerization reaction, a ring-opening polymerization reaction, polyaddition polymerization reaction, an addition condensation reaction and a condensation polymerization reaction in a solvent to prepare a resin solution, dissolving a suitable emulsifier therein, and adding water thereto to phase-inversion emulsify.

The fine resin particles preferably have a volume-average particle diameter of from 10 to 300 nm, and more preferably from 30 to 120 nm. When less than 10 nm and greater than 300 nm, the toner may deteriorate in particle diameter distribution.

The oil phase preferably has a concentration of solid contents of from 40 to 80%. When too high, it is difficult to dissolve or disperse, and the viscosity is too high to handle. When too low, the toner deteriorates in productivity.

The toner compositions besides the binder resin such as the colorant and the release agent and their masterbatches may individually be dissolved or dispersed in an organic solvent and mixed in a binder resin solution or dispersion.

The aqueous medium may be water alone, or may be a combination of water and a solvent miscible with water. Examples of the solvent miscible with water include alcohol (e.g., methanol, isopropanol, ethylene glycol), dimethylformamide, tetrahydrofuran, cellosolve (e.g., methyl cellosolve), and lower ketone (e.g., acetone, and methyl ethyl ketone).

When the content of the compound including an active hydrogen group is too much, the toner may deteriorate in particle diameter distribution and may have uneven surface potentials among particles.

The method for emulsifying and/or dispersing in the aqueous medium is not particularly limited, and to which a conventional equipment, such as a low-speed shearing disperser, a high-speed shearing disperser, a friction disperser, a high-pressure jetting disperser and ultrasonic wave disperser, can be employed. Among them, the high-speed shearing disperser is preferable in view of miniaturizing size of particles. In use of the high-speed shearing disperser, the rotating speed is appropriately selected without any limitation, but it is typically from 1,000 to 30,000 rpm, preferably from 5,000 to 20,000 rpm. The temperature for dispersing is typically from 0 to 150° C. (in a pressurized state), and preferably from 20 to 80° C.

In order to remove the organic solvent from the obtained emulsified dispersion liquid, a conventional method known in the art can be used, and for example, a method, in which the temperature of the entire system is gradually increased under normal pressure or reduced pressure, to completely evaporate and remove the organic solvent in the droplets, can be employed.

For washing and drying of the base particles of the toner dispersed in the aqueous medium, conventional techniques can be used.

Specifically, after the solid-liquid separation is performed by a centrifugal separator, or a filter press, the resulting toner cake is again dispersed in ion-exchanged water having the normal temperature to about 40° C., optionally adjusting the pH thereof with acid or alkali, followed by again subjected to solid-liquid separation. This series of operations are repeated a few times to remove impurities or the surfactant, followed by drying by means of a flash dryer, circulation dryer, vacuum dryer, or vibration flash dryer, to thereby obtain toner particles. The fine particle component may be removed from the toner by centrifugal separation or the like during the aforementioned operations, or it may be optionally classified to have the desirable particle size distribution by means of a conventional classifying device after the drying.

The aggregation method mixes a fine resin particle dispersion including at least a binder resin, a colorant particle dispersion, and an optional release agent particle dispersion and aggregates them to granulate toner base particles. The fine resin particle dispersion can be prepared by known methods such as emulsion polymerization, seed polymerization and phase-inversion emulsification methods. The colorant particle dispersion and the release agent particle dispersion can be prepared by dispersing a colorant and a release agent in an aqueous medium by known wet dispersion methods, etc.

In order to control the aggregation state, a method such as heating, adding a metal salt, and adjusting pH can be preferably used.

The metal salt is appropriately selected depending on the intended purpose without any limitation, and examples thereof include: a monovalent metal salt including salts of sodium and potassium; a bivalent metal salt including salts of calcium and magnesium; and a trivalent metal salt including a salt of aluminum.

Examples of an anion for constituting the aforementioned salt include chloride ion, bromide ion, iodide ion, carbonic ion, and sulfuric ion. Among them, magnesium chloride, aluminum chloride, a complex or multimer thereof are preferable.

Heating during or after the aggregating accelerates fusion between resin particles, which is preferable in terms of homogeneity of the toner. Further, the shapes of the toner particles, i.e., the shape of the toner, can be controlled by the heating. Generally, the shapes of the toner particles become closer to spherical shapes as heating continues.

For washing and drying of the toner base particles dispersed in the aqueous medium, the above techniques can be used.

To improve the fluidity, preservability, developability and transferability of a developer, inorganic fine particles, such as a hydrophobic silica fine powder as mentioned above, are externally added thereto.

A conventional powder mixer can be used to mix the external additive, and the mixer preferably has a jacket and can control an inner temperature thereof. To change a history of a load to the external additive, the external additive may be added to the toner completely prior to mixing or gradually added thereto during mixing. As a matter of course, the number of revolutions, rolling speed, time and temperature of the mixer may be changed. A large load first and next a small load, or vice versa may be applied to the toner. Specific examples of the mixer include a V-form mixer, a locking mixer, a Loedge Mixer, a Nauter Mixer, a Henshel Mixer, etc. Next, the toner is sifted through a sift having not less than 250 meshes to remove coarse or aggregated particles.

The toner preferably includes a core particle including at least a binder resin, a colorant and a release agent; and fine resin particles adhering to the surface of the core particle. An amount of release agent abstracted from 1.0 g of the toner with n-hexane is preferably from 10 to 26 mg.

The toner preferably has a projection formed of the fine resin particles adhering to the surface of the core particle. The projection suppresses the toner from adhering to the developing roller in combination with the surface profile of the roller to further suppress filming.

Specific examples of the fine resin particles include vinyl resins formed by polymerizing a monomer mixture including styrene monomers. The fine resin particles preferably have a particle diameter of from 80 to 110 nm. Further, the fine resin particles preferably occupy the surface of the toner by 50 to 80%.

Figure 3:
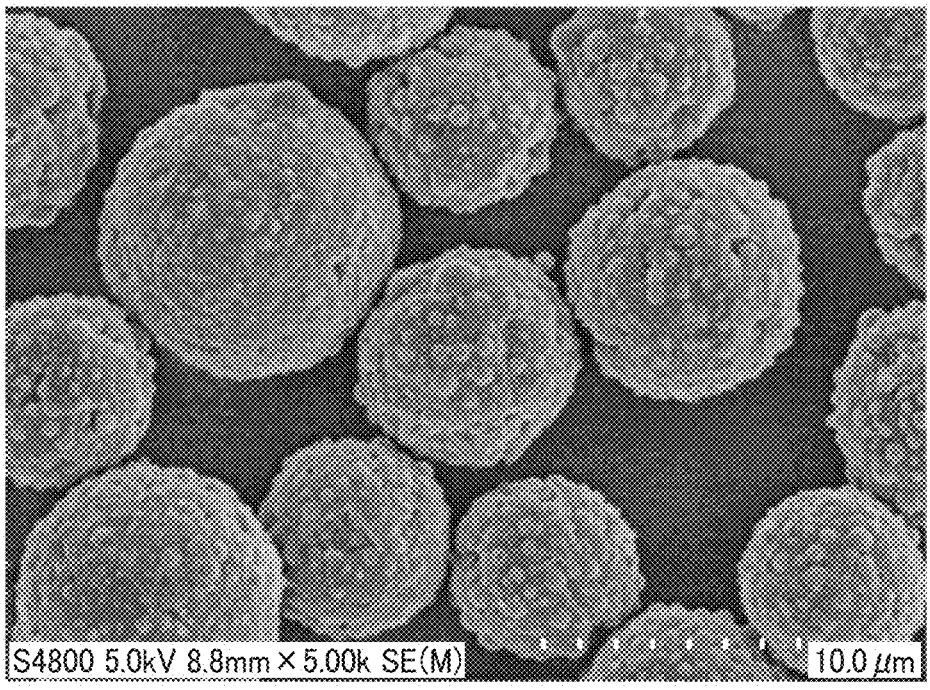
FIG. 3 is a scanning electron microscope (SEM) image of an embodiment of the toner of the present invention.

FIG. 3 is an SEM image of an embodiment of the toner having the projection.

(Image Forming Apparatus and Image Forming Method)

The image forming apparatus of the present invention includes a latent image bearer bearing a latent image, a charger uniformly charging the surface of the latent image bearer, an irradiator irradiating the charged surface of the latent image bearer on the basis of image data to write an electrostatic latent image thereon, an image developer feeding a toner to the electrostatic latent image formed on the latent image bearer to be visualized, a transferer transferring the visible image onto a transfer material, and a fixer fixing the visible image on the transfer material. The image developer is the developing roller of the present invention.

The image forming method of the present invention includes a charging process uniformly charging the surface of a latent image bearer, an irradiation process irradiating the charged surface of the latent image bearer on the basis of image data to write an electrostatic latent image thereon, a developing process feeding a toner to the electrostatic latent image formed on the latent image bearer to be visualized, a transfer process transferring the visible image onto a transfer material, and a fixing process fixing the visible image on the transfer material.

Hereinafter, the details are explained. A photoconductor is the latent image bearer.

Figure 4:
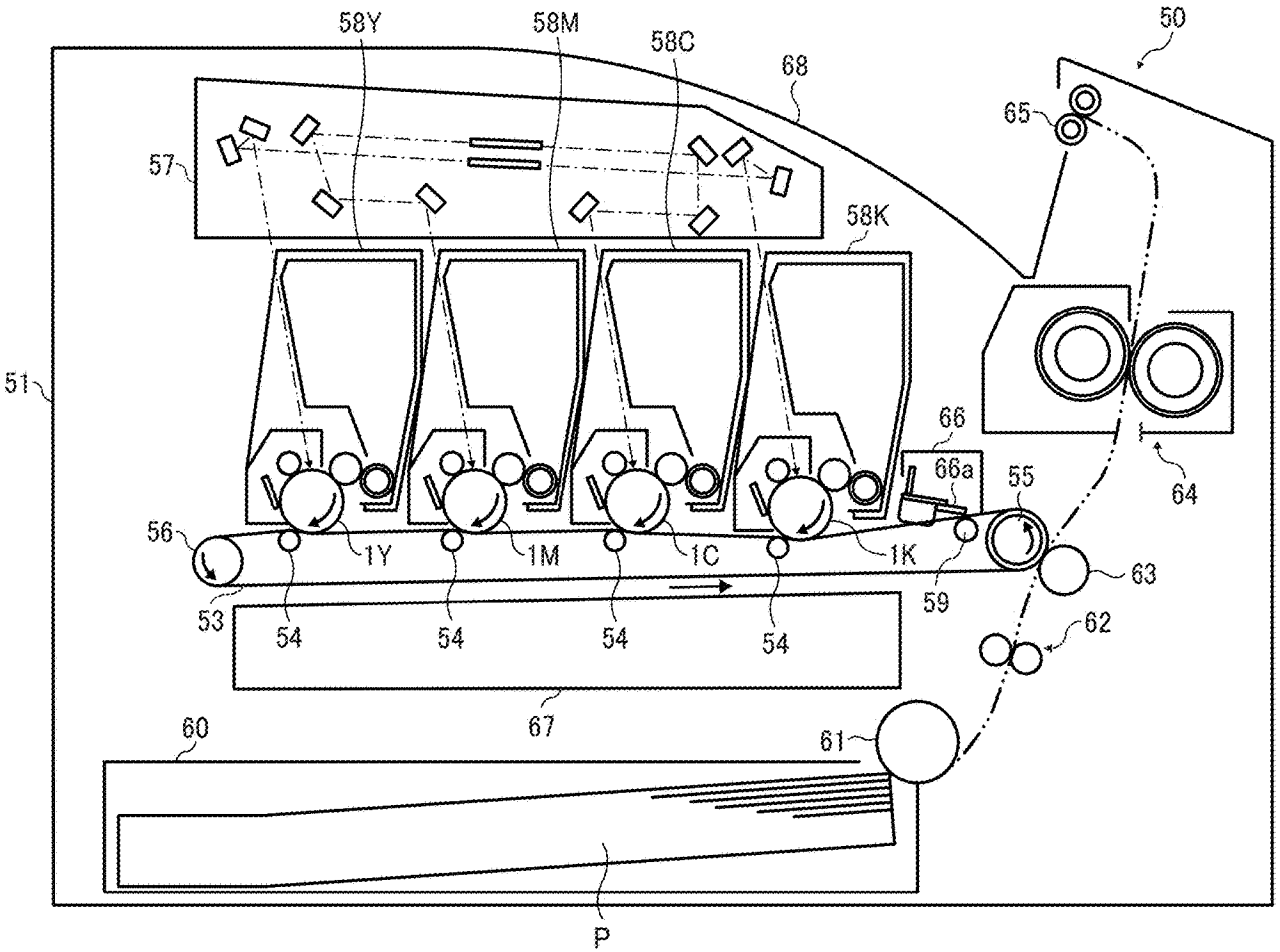
FIG. 4 is a schematic cross-sectional view illustrating an embodiment of the image forming apparatus of the present invention.

First, based on FIG. 4, all configurations and operations of the embodiment of the image forming using one-component developing method are explained.

FIG. 4 is a schematic cross-sectional view illustrating an inner configuration of the image forming apparatus 50. The image forming apparatus 50 is a color printer, but may be a monochrome or a color FAX, printer or multifunctional machine.

As FIG. 4 shows, the image forming apparatus 50 includes 4 process cartridges 58K, 58C, 58M, and 58Y at the center of a body frame 51. An irradiator 57 is located above the process cartridges 58K, 58C, 58M, and 58Y to form a latent image on each of photoconductors 1K, 1C, 1M and 1Y. Black toner images, cyan toner images, magenta toner images and yellow toner images are formed on the photoconductors 1K, 1C, 1M and 1Y, respectively.

The process cartridges 58K, 58C, 58M, and 58Y differ from each other only in the color of toner used as a developer, and hereinafter a process cartridge 58 is explained as a representative of them. In the same way, a photoconductor 1 is explained as a representative of the photoconductors 1K, 1C, 1M and 1Y.

Figure 5:
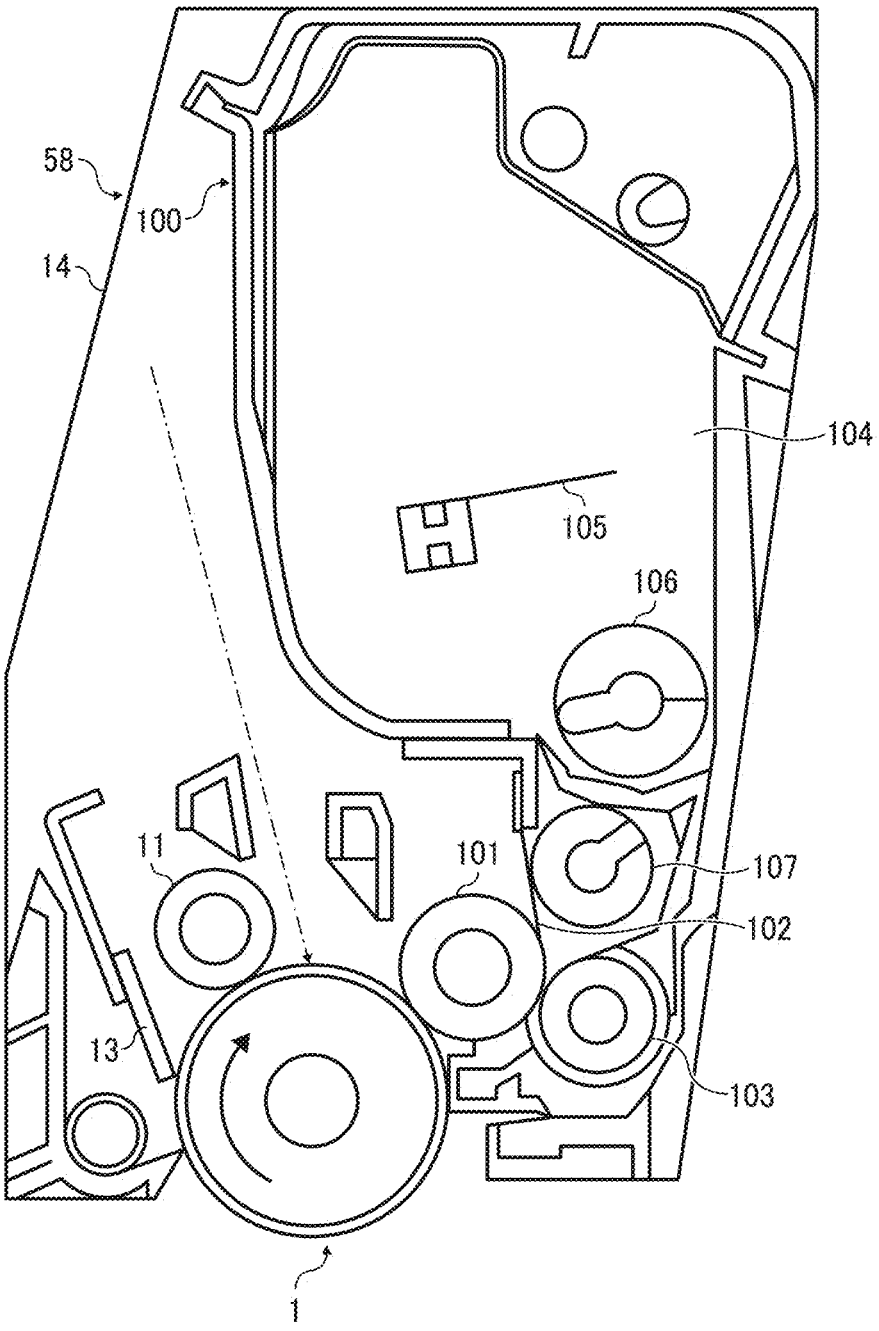
FIG. 5 is a schematic cross-sectional view illustrating an embodiment of process cartridge.

The process cartridge 58 includes, as FIG. 5 shows, the photoconductor 1, a charging roller 11, a cleaning blade 13 and an image developer 100 in a frame 14. The process cartridge 58 is detachable from the body frame 51 of the image forming apparatus 50 through the frame 14.

The charging roller 11 is pressed against the surface of the photoconductor 1, and applied with a bias of DC or AC overlapped with DC by an unillustrated high-pressure electric source while driven to rotate by the rotating photoconductor 1 to uniformly charge the surface thereof at −1,000 to −200 V.

The image developer 100 includes a developing roller 101, a layer thickness regulation member 102 (regulation blade), a feed roller 103, a toner container 104, a stirring member 105, and stirring and conveying screws 106 and 107.

A toner contained in the toner container 104 is stirred by the rotating stirring member 105 to be loosened and conveyed by the conveying screws 106 and 107 to the feed roller 103. The feed roller 103 feeds the toner adhering to the surface thereof to the surface of the developing roller 101.

The developing roller 101 rotates bearing the toner fed from the feed roller 103. The layer thickness regulation member 102 forms a thin and charged layer of the toner on the developing roller 101. The developing roller 101 is applied with a developing bias by unillustrated high-pressure electric source to form an electric field with the photoconductor 1 and feeds the toner to the electrostatic latent image on the surface thereof to form a toner image.

A free end of the layer thickness regulation member 102 is pressed against the surface of the developing roller 101 to form a thin layer of the toner passing between the layer thickness regulation member and the developing roller 101 and charge the toner by friction.

A developing electric field is formed between the developing roller 101 and the photoconductor 1 and the toner is fed from a toner layer on the surface of the developing roller 101 to the electrostatic latent image on the surface of the photoconductor 1 to form a toner image thereon.

As FIG. 4 shows, an intermediate transfer belt 53 is located below the process cartridge 58. The intermediate transfer belt 53 is suspended with tension by a first transfer roller 54, a drive roller 55 combining a second transfer roller, a cleaning roller 50 and a driven roller 56 combining a tension roller. The intermediate transfer belt 53 is driven by the drive roller 55 to rotate.

The toner image formed on the surface of each of the photoconductors 1 is transferred onto the intermediate transfer belt 53 while overlapped by a transfer electric field formed between the photoconductor 1 and the first transfer roller 54 to form a color toner image.

Below the intermediate transfer belt 53, a paper feed cassette 60 containing papers P as recording media is located. The toner image on the intermediate transfer belt 53 is second transferred onto the paper P when conveyed by a paper feed roller 61 and a conveyance roller 62 between a second transfer roller 63 and the intermediate transfer belt 53. An untransferred toner remaining on the surface of the intermediate transfer belt 53 after the toner image is transferred onto the paper P is scraped by a blade 66*a* of a cleaner 66 and collected by a toner collector 67.

The toner image on the paper P is fixed thereon with heat and pressure when the paper P passes a fixer 64, and the paper P the toner image is fixed on is ejected by a paper ejection roller 65 onto a paper ejection tray 68.

The image forming apparatus 50 prints an image on the paper P and ejects the printed paper P out through the above configurations and operations. The image forming apparatus is not limited to this embodiment, and the toner image may directly be transferred onto the paper P.

Next, the cleaner equipped in the image forming apparatus of the present invention is explained in detail.

As a typical problem of the developing roller having less filming is filming of toner components on the photoconductor at an early stage. This is because toner components which have to adhere to the developing roller to cause filming transfer onto the photoconductor to cause photoconductor filming, which causes production of abnormal images.

Figure 6A:
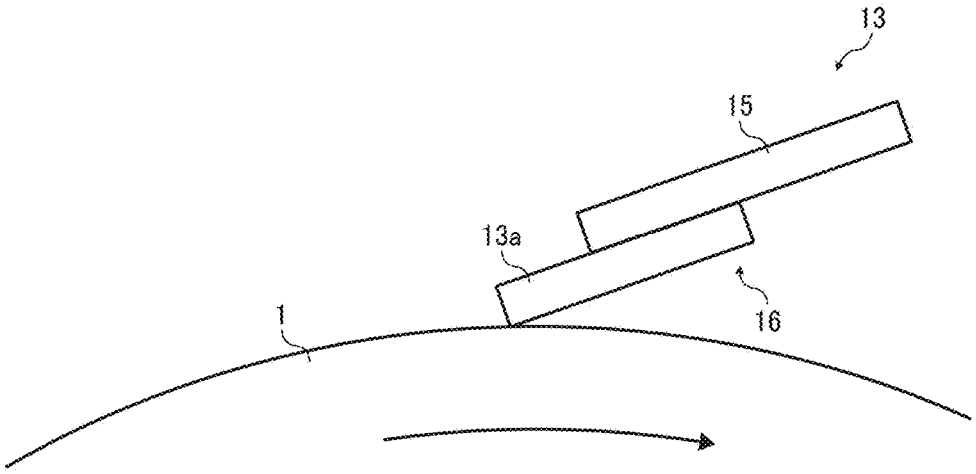
FIG. 6A is a schematic view illustrating an embodiment of cleaning blade.
Figure 6B:
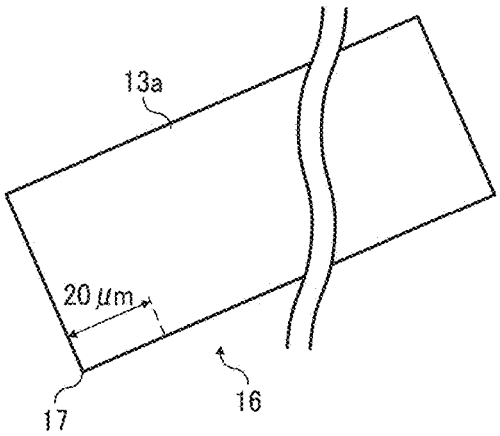
FIG. 6B is a schematic amplified view illustrating a main part of the cleaning blade in FIG. 6A.

In the present invention, a configuration of the cleaning blade capable of improving photoconductor filming due to high developing roller filming resistance is disclosed as well. As FIG. 5 shows, the embodiment further includes a cleaner having a cleaning blade contacting a latent image bearer (photoconductor) to clean a toner adhering thereto FIG. 6A is a schematic view illustrating an embodiment of cleaning blade, and FIG. 6B is a schematic amplified view illustrating a main part of the cleaning blade in FIG. 6A.

A cleaning blade 13 includes an elastic blade 13*a*, a holder 15 and a surface 16 facing a photoconductor. The photoconductor rotate in an arrow direction. The cleaning blade 13 has a strip-shaped elastic blade 13*a* the tip ridgeline of which contacts the surface of the photoconductor.

The elastic blade 13*a* preferably has a Martens hardness of from 2.0 to 10.0 N/mm$^2$, and more preferably from 4.0 to 6.0 N/mm$^2$ when a Vickers quadrangular pyramid penetrator is pushed into a position by 5 μm, which is 20 μm far from the tip ridgeline 17 at downstream side of the rotational direction of the photoconductor therefrom on the surface facing the photoconductor.

The Martens hardness shows hardness near the tip ridgeline 17. The cleaning blade having a highly hardened tip can scrape filming components on the photoconductor and suppress the photoconductor filming.

The elastic blade 13*a* is preferably formed of a urethane rubber including a urethane group, having high repulsion elasticity so as to follow eccentricity of the photoconductor and microscopic waves on the surface thereof.

The tip ridgeline 17 of the elastic blade 13*a* is preferably impregnated with a UV curing resin. UV light is irradiated to the UV curing resin in the tip ridgeline 17 to prepare a cleaning blade having a desired hardness at low cost. The elastic blade 13*a* is preferably impregnated with the UV curing resin by brush coating, spray coating or dip coating.

The elastic blade 13*a* is preferably impregnated at a width which is the same as thickness of the elastic blade from the tip surface.

The UV curing resin preferably includes a fluorine acrylic monomer. Acrylate having a perfluoropolyether skeleton and two or more functional groups is preferably used as the fluorine acrylic monomer.

The fluorine acrylic monomer, particularly the acrylate having a perfluoropolyether skeleton and two or more functional groups can increase slidability of the cleaning blade with a fluorine group and prevent the blade from turning up. In addition, the two or more functional groups crosslink with other acrylic monomers to form a crosslinked film.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Examples 1 to 18 and Comparative Examples 1 to 4

Based on the following formulae 1 to 3 to form conductive elastic layers and the formulae 1 to 9 to form toner bearing layer, developing rollers were prepared.

<Formation of Conductive Elastic Layer>

—Formulation 1—

Epichlorohydrin rubber Hydrin T3106 from Zeon Corp. was coated on the surface of a conductive axis having a diameter of 8 mm to form a conductive elastic layer having a thickness of 4 mm. The surface of the conductive elastic layer was subjected to coarse polishing by a rubber polisher LEO-600-F4L-BME from Minakuchi Machinery Works, Ltd.

—Formulation 2—

Epichlorohydrin rubber Hydrin T3106 from Zeon Corp. was coated on the surface of a conductive axis having a diameter of 8 mm to form a conductive elastic layer having a thickness of 4 mm. The surface of the conductive elastic layer was subjected to coarse and finish polishing by a rubber polisher LEO-600-F4L-BME from Minakuchi Machinery Works, Ltd.

—Formulation 3—

After the finish polishing in the formulation 2, the surface of the conductive elastic layer was further polished by a polisher SZC from Minakuchi Machinery Works, Ltd.

<Formation of Toner Bearing Layer>

Coating materials of the following formulations were mixed, and 0.1 parts of a catalyst NEOSTANN U-820 from Nitto Kasei Co., Ltd. was added to the mixture to prepare a toner bearing layer coating liquid.

Next, on the conductive elastic layer, the toner bearing layer coating liquid was coated by roll coating. The coating liquid was subjected to annealing at 100° C. for 0.5 hrs and 145° C. for 1 hr to be cured with heat and form a toner bearing layer having a thickness of from 1 to 3 μm on the conductive elastic layer. Thus, a developing roller having a diameter of 16 mm was prepared.

-Formulation 1-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.033 |

-continued

-Formulation 1-

| | |
|---|---|
| Carbon Black from Fuji Pigment Co., Ltd. | 0.26 |
| Hydrophobic silica H-20TM from Clariant | 0.084 |
| Cyclohexanone | 1.7 |
| Butylacetate | 6.8 |

-Formulation 2-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Hydrophobic silica H-20TM from Clariant | 0.058 |
| Butylacetate | 8.6 |

-Formulation 3-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Titanium oxide STT-30EHJ from Titan Kogyo, Ltd. | 0.116 |
| Butylacetate | 8.6 |

-Formulation 4-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Hydrophobic silica H-20TM from Clariant | 0.011 |
| Butylacetate | 2.3 |

-Formulation 5-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 3.28 |
| Carbon Black from Fuji Pigment Co., Ltd. | 0.77 |
| Hydrophobic silica H-20TM from Clariant | 0.248 |
| Cyclohexanone | 9.4 |
| Butylacetate | 38 |

-Formulation 6-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Aluminum oxide NanoTek from C. I. Kasei Co., Ltd. | 0.084 |
| Butylacetate | 8.6 |

-Formulation 7-

| | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Silica sicaster 10 nm from Corefront Corp. | 0.058 |
| Butylacetate | 8.6 |

| -Formulation 8- | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Silica sicaster 50 nm from Corefront Corp. | 0.174 |
| Butylacetate | 8.6 |

| -Formulation 9- | |
|---|---|
| Hexamethylene diisocyanurate D170N from Mitsui Chemicals, Inc. | 1 |
| Fluorine polyol Lumiflon LF200MEK from Asahi Glass Co., Ltd. | 0.109 |
| Carbon Black from Fuji Pigment Co., Ltd. | 0.27 |
| Hydrophobic silica H-20TM from Clariant | 0.333 |
| Butylacetate | 7.5 |

<Cleaning Blade>

Each of blades 1 to 9 having the following formulations were used for the cleaning blade.

—Blade 1—

Urethane rubber having a Martens hardness of 0.8 N/mm$^2$ from Toyo Tire & Rubber Co., Ltd.

—Blade 2—

Double-layered urethane rubber having a Martens hardness of 1.8 N/mm$^2$ at the contact side and 0.7 N/mm$^2$ at the other side from Toyo Tire & Rubber Co., Ltd.

—Blades 3 to 9—

After a urethane rubber having a hardness of 68° and a repulsion elasticity of 30% at 25° C. from Toyo Tire & Rubber Co., Ltd. was impregnated in each of coating liquids having the following formulae, the impregnated urethane rubber was irradiated with UV and burned in a furnace at 100° C. for 15 min to prepare blades 3 to 9.

| [Coating Liquid Composition 1] | |
|---|---|
| UV curing resin 1: pentaerythritol triacrylate (PETIA from DAICEL-CYTEC Co., Ltd., having three functional groups and functional group equivalent of 99) | 9 |
| UV curing resin 2: fluorine acrylate (OPTOOL DAC-HP from DAIKIN INDUSTRIES, Ltd.) | 1.1 |
| Polymerization initiator: 1.2α hydroxy alkyl phenone (Irgacure 184 from Ciba Specialty Chemicals | 0.5 |
| Solvent: Cyclohexanone | 89.4 |

| [Coating Liquid Composition 2] | |
|---|---|
| Tricyclodecane dimethanol diacrylate (A-DCP from Shin-Nakamura Chemical Co., Ltd.) | 78 |
| Polymerization initiator: 1.2α hydroxy alkyl phonon (Irgacure 184 from Ciba Specialty Chemicals | 2 |
| Solvent: Cyclohexanone | 20 |

Details of the blades 3 to 9 are as follows. The Martens hardness was measured by a method mentioned later.

| | | Impregnation Time | Martens hardness |
|---|---|---|---|
| Blade 3 | Coating Liquid Composition 1 | 15 sec | 2.0 N/mm$^2$ |
| Blade 4 | Coating Liquid Composition 1 | 30 sec | 4.0 N/mm$^2$ |
| Blade 5 | Coating Liquid Composition 2 | 15 min | 4.5 N/mm$^2$ |
| Blade 6 | Coating Liquid Composition 2 | 21 min | 6.0 N/mm$^2$ |
| Blade 7 | Coating Liquid Composition 2 | 30 min | 7.5 N/mm$^2$ |

-continued

| | | Impregnation Time | Martens hardness |
|---|---|---|---|
| Blade 8 | Coating Liquid Composition 1 | 5 min | 10.0 N/mm$^2$ |
| Blade 9 | Coating Liquid Composition 2 | 42 min | 10.2 N/mm$^2$ |

(Measurement and Evaluation)

The following measurements and evaluations were made on the developing rollers.

<Measurement of Rotary Torque of Developing Roller>

A PET film (Lumilar S10 from Toray Industries, Inc.) having a thickness of 0.1 mm and a width of 15 mm was hung on the circumferential surface of the developing roller as shown in FIG. 2, and one end of the PET film is horizontally attached to a digital force gauge and the other end is attached to a weight of 50 g. The PET film is contacted to the surface of the developing roller at a section view of 90° perpendicular to the axial direction, and the developing roller is rotated at 180 rpm to see a value of the digital force gauge. The digital force gauge is adjusted to have a value 0 when neither the PET film nor the weight is attached to.

Next, when the value of the digital force gauge while the PET film and the weight are attached thereto becomes stable, the developing roller is rotated anticlockwise at 180 rpm in a direction indicated by an arrow R to frictionize the PET film. Then, a friction force between the developing roller and the PET film is measured by the digital force gauge. Analog output values therefrom are subjected to sampling at a rate of 100 points/sec, and an average value of sampled 1,000 points data is produced from a computer, which is determined as a rotary torque.

<Measurement of Gap Between Concavity and Convexity Adjacent to Each Other on Developing Roller>

A gap between a concavity and a convexity adjacent to each other on the surface of the developing roller in the longitudinal direction was measured by observing the surface profile thereof using a laser microscope LEXT OLS4100 with 100-time lens from Olympus Corp.

2 points 4 cm from both ends of the rubber of the developing roller and the center thereof were measured, and the same positions of the roller after rotated at an angle of 90° three times, i.e., totally 12 points were measured and averaged.

<Measurement of Roughness Skewness Rsk>

A linear roughness of the surface of the developing roller in the longitudinal direction by a laser microscope LEXT OLK4100 from OLYMPUS Corp. with an objective lens of 50 magnifications in a roughness measurement mode. Points 4 cm from both ends of the rubber of the roller and the center thereof, and the same positions of the roller after rotated at an angle of 90° three times, i.e., totally 12 points were measured and averaged.

<Measurement of Martens Hardness>

After left in an NN environment (23° C., Rh 45%) for 24 hrs, the surface of the cleaning blade opposite to the photoconductor at downstream side in the rotational direction of the photoconductor 20 μm from the tip ridgeline of the cleaning blade was pushed in by 5 μm by a microscopic hardness tester FISHERSCOPE HM2000 from Fischer Technology, Inc. The Vickers quadrangular pyramid penetrator was pushed in by 5 μm at a load of 2 mN for 20 sec and a creep time was 5 sec.

<Regulation Blade Anchorage, Filming, Solid Image Followability and Photoconductor Filming>

After 5,000 pieces of predetermined image pattern of 1% chart were produced by IPSiO SP C730 from Ricoh Company, Ltd. in an NN environment (23° C., Rh 45%), the following items were evaluated.

—Regulation Blade Anchorage—

The regulation blade was observed by a stereomicroscope system SMZ1270 from Nikon Corp. to see whether there was anchorage on the regulation blade.

Evaluation criteria is as follows.

Excellent: No anchorage

Good: Slight anchorage, but does not appear on images and no problem in practical use Poor: Anchorage appears on images and is a problem in practical use —Filming—

Silica (Si) included in an external additive of a toner is likely to adhere to the developing roller. The silica adhering thereto increases as time passes. The developing roller being used for long periods was measured by ATR method to use the peak intensity as a degree of filming.

After 5,000 images were produced, the developing roller was taken out and a toner on the surface thereof was removed by air blow to be analyzed by FT-IR (NEXUS470 from Thermo Nicolet) and ATR method. From the absorption spectrum, the peak intensity of the external additive Si (near 470 $cm^{-1}$) was determined to evaluate by the following criteria. The higher the peak intensity, the more the toner filming on the developing roller.

Excellent: Peak intensity of silica <0.05

Good: 0.05≤Peak intensity of silica <0.1

Fair: 0.1≤Peak intensity of silica <0.3

Poor: 0.3≤Peak intensity of silica

—Solid Image Followability—

After 5,000 images were produced, two solid images were continuously produced to visually observe thinning of the second image and evaluate the image by the following criteria.

Excellent: No thinning of images even at the end edge of the image and no problem in image quality Good: Slight thinning of images at the end edge of the image, but no problem in image quality Poor: Serious thinning of images at the end edge of the image and is a problem in image quality —Photoconductor Filming—

After 1,000 pieces of predetermined image pattern of 1% chart were produced by IPSiO SP C730 from Ricoh Company, Ltd. in an NN environment (23° C., Rh 45%), abnormal images due to photoconductor filming were evaluated. The same evaluations were repeated every 1,000 images until 15,000 images were produced.

When photoconductor filming occurs, it appears on images at a photoconductor cycle.

Excellent: No abnormal image even after 15,000 images were produced

Good: Abnormal images were produced when not less than 10,000 to less than 15,000 images were produced (No problem in practical use)

Fair: Abnormal images were produced when not less than 5,000 to less than 10,000 images were produced (problem in practical use)

Poor: Abnormal images were produced when less than 5,000 images were produced (problem in practical use)

<Preparation of Toner>

A toner used for the evaluation was prepared with reference to Example 1 of Japanese published unexamined application No. JP-2013-025289-A.

—Polyester 1—

A reaction container equipped with a condenser, a stirrer and a nitrogen-introducing pipe was charged with bisphenol A ethylene oxide 2 mol adduct (2,765 parts), bisphenol A propylene oxide 2 mol adduct (480 parts), terephthalic acid (1,100 parts), adipic acid (225 parts) and dibutyltinoxide (10 parts), followed by reaction at 230° C. for 8 hours under normal pressure. Next, the reaction mixture was allowed to react for 5 hours at a reduced pressure of 10 mmHg to 15 mmHg. Then, trimellitic anhydride (130 parts) was added to the reaction container, followed by reaction at 180° C. for 2 hours under normal pressure, to thereby synthesize [polyester 1]. The thus-obtained [polyester 1] was found to have a number-average molecular weight of 2,600, a weight-average molecular weight of 8,000, a glass transition temperature of 68° C. and an acid value of 20.

—Polyester 2—

A reaction container equipped with a condenser, a stirrer and a nitrogen-introducing pipe was charged with bisphenol A ethylene oxide 2 mol adduct (1,195 parts), bisphenol A propylene oxide 3 mol adduct (2,765 parts), terephthalic acid (900 parts), adipic acid (200 parts) and dibutyltinoxide (10 parts), followed by reaction at 230° C. for 8 hours under normal pressure. Next, the reaction mixture was allowed to react for 5 hours at a reduced pressure of 10 mmHg to 15 mmHg. Then, trimellitic anhydride (220 parts) was added to the reaction container, followed by reaction at 180° C. for 2 hours under normal pressure, to thereby synthesize [polyester 2]. The thus-obtained [polyester 2] was found to have a number average molecular weight of 2,000, a weight average molecular weight of 9,000, a glass transition temperature of 73° C. and an acid value of 19.

—Polyester 3—

A reaction container equipped with a condenser, a stirrer and a nitrogen-introducing pipe was charged with bisphenol A ethylene oxide 2 mol adduct (264 parts), bisphenol A propylene oxide 2 mol adduct (523 parts), terephthalic acid (123 parts), adipic acid (173 parts) and dibutyltinoxide (1 part), followed by reaction at 230° C. for 8 hours under normal pressure. Next, the reaction mixture was allowed to react for 8 hours at a reduced pressure of 10 mmHg to 15 mmHg. Then, trimellitic anhydride (26 parts) was added to the reaction container, followed by reaction at 180° C. for 2 hours under normal pressure, to thereby synthesize [polyester 3]. The thus-obtained [polyester 3] was found to have a number average molecular weight of 4,000, a weight average molecular weight of 47,000, a glass transition temperature of 65° C. and an acid value of 12.

—Polyester 4—

A reaction container equipped with a condenser, a stirrer and a nitrogen-introducing pipe was charged with 1, 6-hexanediol (500 parts), succinic acid (500 parts) and dibutyltinoxide (2.5 parts), followed by reaction at 200° C. for 8 hours under normal pressure. The reaction mixture was further allowed to react for 1 hour at a reduced pressure of 10 mmHg to 15 mmHg, to thereby obtain [polyester 4]. The [polyester 4] was found to have an endothermic peak of 66° C. as measured by DSC.

—Synthesis of Prepolymer—

A reaction container equipped with a condenser, a stirrer and a nitrogen-introducing pipe was charged with 1,2-puropylene glycol (366 parts), terephthalic acid (566 parts), trimellitic anhydride (44 parts) and titanium tetrabutoxide (6 parts), followed by reaction at 230° C. for 8 hours under normal pressure. Additionally, the reaction mixture was allowed to react for 5 hours at a reduced pressure of 10 mmHg to 15 mmHg, to thereby obtain [intermediate polyester 1]. The thus-obtained [intermediate polyester 1] was found to have a number average molecular weight of 3,200, a weight average molecular weight of 12,000, and a glass transition temperature of 55° C.

Next, a reaction container equipped with a condenser, a stirrer and a nitrogen-introducing pipe was charged with [intermediate polyester 1] (420 parts), isophorone diisocyanate (80 parts) and ethyl acetate (500 parts), followed by reaction at 100° C. for 5 hours, to thereby obtain [prepolymer]. The obtained [prepolymer] was found to have a free isocyanate of 1.34% by weight.

—Preparation of Fine Resin Particle Dispersion—

[Vinyl Copolymer Fine Resin Particle V-1]

A reaction container equipped with a condenser, a stirrer and a nitrogen-introducing pipe was charged with sodium lauryl sulfate (1.6 parts) and ion-exchange water (492 parts), followed by heating to 80° C. Then, a solution of potassium persulfate (2.5 parts) in ion-exchange water (100 parts) was added to the resultant solution. Fifteen minutes after the addition, a mixture of a styrene monomer (170 parts), butylacrylate (30 parts), and n-octyl mercaptan (1.2 parts) was added dropwise to the resultant mixture for 90 min. Subsequently, the temperature of the mixture was maintained at 80° C. for 60 min. Then, the reaction mixture was cooled to obtain a dispersion liquid of [fine resin particles V-1]; i.e., fine particles of vinyl copolymer resin. The solid content concentration of the obtained dispersion liquid was measured and found to be 25%. Also, the volume average particle diameter of the fine particles was found to be 110 nm. Subsequently, a small portion of the thus-obtained dispersion liquid was added to a Petri dish, where the dispersion medium was evaporated. The obtained solid product was measured for number average molecular weight, weight average molecular weight and Tg, which were found to be 21,000, 43,000 and 70° C., respectively.

<Preparation of Masterbatch>

Carbon black (REGAL 400R, product of Cabot Corporation) (40 parts), a binder resin (polyester resin) (60 parts) (RS-801, product of Sanyo Chemical Industries, Ltd., acid value: 10, Mw: 20,000, Tg: 64° C.) and water (30 parts) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm in diameter, whereby [masterbatch 1] was obtained.

Example 1

Preparation of Oil Phase

A container to which a stirring rod and a thermometer had been set was charged with [polyester 1] (4 parts), [polyester 4] (20 parts), [paraffin wax (melting point: 72° C.)] (8 parts) and ethyl acetate (96 parts). The mixture was increased in temperature to 80° C. under stirring, maintained at 80° C. for 5 hours, and cooled to 30° C. in 1 hour. Then, the container was charged with [masterbatch 1] (35 parts), followed by mixing for 1 hour. The obtained mixture was placed in another container, where the mixture was dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes, to thereby obtain [raw material solution 1]. Next, 74.1 parts of a 70% ethyl acetate solution of the [polyester 1], 21.6 parts of the [polyester 3] and 21.5 parts of ethyl acetate were added to 81.3 parts of the [raw material solution 1], followed by stirring with a three-one motor for 2 hours, to thereby obtain [oil phase 1]. Furthermore, ethyl acetate was added to the [oil phase 1] so that the solid content concentration thereof was adjusted to 49% as measured at 130° C. for 30 min.

[Preparation of Aqueous Phase]

Ion-exchange water (472 parts), a 50% aqueous solution of sodium dodecyl diphenyl ether disulfonate (ELEMINOL MON-7, product of Sanyo Chemical Industries Ltd.) (81 parts), a 1% aqueous solution of carboxy methyl cellulose serving as a thickening agent (67 parts) and ethyl acetate (54 parts) were mixed together and stirred to obtain an opaque white liquid, which was used as [aqueous phase 1].

[Emulsification Process]

The [aqueous phase 1] (321 parts) was added to the total amount of the above-obtained [oil phase 1] after mixed at 5,000 rpm for 1 min by TK homomixer from PRIMIX Corp. The resultant mixture was stirred with the TK homomixer at 8,000 rpm to 13,000 rpm for 20 min, to thereby obtain [core particles slurry 1].

[Shell Formation Process (Attachment Process of Fine Resin Particles onto Core Particles)]

While the [core particles slurry 1] was being stirred with a three-one motor at 200 rpm, the [fine resin particles V-1 of vinyl copolymer] (21.4 parts) was added dropwise thereto for 5 min and then stirred for 30 min. Thereafter, a small amount of the slurry was sampled and diluted with water having an amount of 10 times the amount of the slurry, followed by centrifugating with a centrifugal apparatus, so that toner base particles sedimented on the bottom of the test tube and the supernatant was almost transparent. In this manner, [post-shell formation slurry 1] (i.e., a slurry obtained after the shell formation process) was obtained.

[Desolvation]

A container to which a stirrer and a thermometer had been set was charged with the [post-shell formation slurry 1] and then desolvated at 30° C. for 8 hours to obtain [dispersion slurry 1].

[Washing→Drying]

After [dispersion slurry 1] (100 parts) had been filtrated under reduced pressure, the following treatments (1) to (4) were performed.

(1) Ion-exchange water (100 parts) was added to the filtration cake, followed by mixing with a TK homomixer (at 12,000 rpm for 10 min) and filtrating.

(2) Ion-exchange water (100 parts) was added to the filtration cake obtained in (1). The resultant mixture was mixed with a TK homomixer (at 12,000 rpm for 30 min) under application of ultrasonic vibration, followed by filtrating under reduced pressure. This treatment was repeated until the reslurry had an electrical conductivity of 10 μS/cm or lower.

(3) 10% hydrochloric acid was added to the reslurry obtained in (2) so as to have a pH of 4, followed by stirring for 30 min with a three-one motor and filtrating.

(4) Ion-exchange water (100 parts) was added to the filtration cake obtained in (3), followed by mixing with a TK homomixer (at 12,000 rpm for 10 min) and filtrating. This treatment was repeated until the reslurry had an electrical conductivity of 10 μS/cm or lower, to thereby obtain [filtration cake 1]. The untreated [dispersion slurry 1] was similarly washed, and the obtained filtration cake was mixed with the [filtration cake 1].

The [filtration cake 1] was dried with an air-circulation dryer at 45° C. for 48 hours, and then sieved with a mesh having an opening size of 75 μm to obtain [toner base 1]. The obtained [toner base 1] (50 parts) was mixed using HENSCHEL MIXER with 1 part of hydrophobic silica having a primary particle diameter of about 30 nm and 0.5 parts of hydrophobic silica having a primary particle diameter of about 10 nm, to thereby obtain [developer 1] according to the present embodiment.

Examples 2 to 18 and Comparative Examples 1 to 4

The procedure for preparation of the toner in Example 1 was repeated except for changing the content of the wax, a ratio between the oil phase and the aqueous phase, a ratio of the organic solvent in the oil phase, a viscosity of the aqueous phase, etc. to prepare toners of Examples 2 to 18 and Comparative Examples 1 to 4.

<Measurement of Toner>

The following properties of the toners were measured.

—Glass Transition Temperature (Tg)—

TG-DS system TAS-100 from Rigaku Corp. was used. First, about 10 mg of the sample was placed in an aluminum sample container, which is loaded on a holder unit, and which was set in an electric oven. Next, after the sample was heated to 150° C. at 10° C./min from room temperature, it was left for 10 min at 150° C., it was cooled to room temperature and left for 10 min, and it was heated to 150° C. at 10° C./min again in a nitrogen atmosphere to make DSC measurement. The glass transition temperature (Tg) was calculated from a contact point between a tangential line of an endothermic curve near the glass transition temperature (Tg) and the base line.

—Amount of Wax Exposed on Surface—

At room temperature, 7 ml of n-hexane was added to 1 g of the toner, and the mixture was stirred by a roll mill at 120 rpm for 1 min. The solution after stirred was immediately suctioned and filtered. The filtrate was vacuum dried at 40° C. for 30 min, and the quantity of the wax dissolved out from the surface was determined. A membrane filter formed of PTFE having an opening of 1 μm was used as a filter used for the filtration.

—Volume-Average Particle Diameter and Particle Diameter Distribution—

A volume-average particle diameter (Dv) and a particle diameter distribution of the toner were measured by Coulter Multisizer 3 from Beckman Coulter, Inc. Specifically, 0.1 to 5 ml of a surfactant alkylbenzenesulfonate were added to 100 to 150 ml of electrolyte which is an NaCl aqueous solution having a concentration about 1% with a primary sodium chloride using ISOTON-II from Beckman Coulter, Inc. After 2 to 20 mg of a toner were added to the mixture, the mixture was dispersed by an ultrasonic disperser Tetra 150 from Beckman Coulter, Inc. for 1 to 3 min. A particle diameter distribution of the toner was measured with an aperture diameter of 100 μm. The scope of analysis was 2 to 20 μm (2.00 to 19.98 μm).

—Average Circularity—

A flow-type particle image analyzer FPIA-3000S was used to measure the average circularity.

A specific measuring method included adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser Tetra 150 from Beckman Coulter, Inc. for 1 to 3 min to prepare a dispersion liquid having a concentration of from 3,000 to 10,000 pieces/μl; and measuring the toner shape and distribution with the above-mentioned measurer.

The formulation, measurement and evaluation of each of the developing roller and properties of each of the toners are shown in Table 1.

Comparative Example 3 has high cleanability because of high Martens hardness, but is easy to chip, resulting in blade abrasion.

TABLE 1

(1)

| | Developing Roller | | | | | |
|---|---|---|---|---|---|---|
| | Conductive Elastic Layer | Toner Bearing Layer | Particle Diameter of Fine Particle | Rotary Torque | Rsk | Gap between adjacent concavity and convexity |
| Example 1 | Formulation 3 | Formulation 1 | 12 nm | 2.5N | −0.63 | 0.9 μm |
| Example 2 | Formulation 2 | Formulation 1 | 12 nm | 2.7N | −0.61 | 0.8 μm |
| Example 3 | Formulation 2 | Formulation 2 | 12 nm | 3.0N | −0.42 | 2.2 μm |
| Example 4 | Formulation 2 | Formulation 3 | 40 nm | 3.5N | −0.3 | 3.2 μm |
| Example 5 | Formulation 3 | Formulation 3 | 40 nm | 3.2N | −0.27 | 3.1 μm |
| Example 6 | Formulation 2 | Formulation 6 | 31 nm | 3.1N | −0.28 | 1.6 μm |
| Example 7 | Formulation 3 | Formulation 6 | 31 nm | 2.7N | −0.61 | 3.2 μm |
| Example 8 | Formulation 3 | Formulation 4 | 12 nm | 3.2N | −0.64 | 3.0 μm |
| Example 9 | Formulation 1 | Formulation 4 | 12 nm | 2.9N | −0.29 | 0.9 μm |
| Example 10 | Formulation 2 | Formulation 5 | 12 nm | 2.7N | −0.28 | 1.0 μm |
| Example 11 | Formulation 1 | Formulation 1 | 12 nm | 3.3N | −0.52 | 1.6 μm |
| Example 12 | Formulation 1 | Formulation 5 | 12 nm | 3.2N | −0.5 | 1.5 μm |
| Example 13 | Formulation 1 | Formulation 3 | 40 nm | 3.4N | −0.32 | 2.7 μm |
| Example 14 | Formulation 1 | Formulation 2 | 12 nm | 3.1N | −0.35 | 2.8 μm |
| Example 15 | Formulation 2 | Formulation 9 | 12 nm | 2.7N | −0.51 | 1.7 μm |
| Example 16 | Formulation 3 | Formulation 5 | 12 nm | 3.2N | −0.54 | 1.6 μm |
| Example 17 | Formulation 1 | Formulation 6 | 31 nm | 3.4N | −0.32 | 2.6 μm |
| Example 18 | Formulation 3 | Formulation 2 | 12 nm | 2.8N | −0.34 | 2.7 μm |
| Comparative | Formulation 1 | Formulation 5 | 12 nm | 3.6N | −0.06 | 4.5 μm |

TABLE 1-continued

| | | | | | | |
|---|---|---|---|---|---|---|
| Example 1 | | | | | | |
| Comparative Example 2 | Formulation 2 | Formulation 4 | 12 nm | 2.4N | −0.51 | 2.6 μm |
| Comparative Example 3 | Formulation 2 | Formulation 7 | 10 nm | 2.5N | −0.36 | 0.6 μm |
| Comparative Example 4 | Formulation 2 | Formulation 8 | 50 nm | 3.5N | −0.18 | 1.4 μm |

(2)

| | Cleaning Blade | | Toner | | | | |
|---|---|---|---|---|---|---|---|
| | Blade No. | Martens hardness ($N/mm^2$) | Tg (° C.) | Amount of Wax Exposed (mg) | Dv (μm) | Dv/Dn | Average circularity |
| Example 1 | 3 | 2.0 | 58 | 21 | 7.00 | 1.20 | 0.983 |
| Example 2 | 8 | 10.0 | 62 | 18 | 6.31 | 1.15 | 0.980 |
| Example 3 | 5 | 4.5 | 80 | 16 | 6.29 | 1.15 | 0.980 |
| Example 4 | 4 | 4.0 | 66 | 14 | 5.84 | 1.23 | 0.968 |
| Example 5 | 7 | 7.5 | 65 | 23 | 5.92 | 1.17 | 0.979 |
| Example 6 | 4 | 4.0 | 55 | 21 | 5.49 | 1.15 | 0.983 |
| Example 7 | 6 | 6.0 | 61 | 23 | 5.51 | 1.22 | 0.980 |
| Example 8 | 8 | 10.0 | 45 | 19 | 4.65 | 1.19 | 0.970 |
| Example 9 | 7 | 7.5 | 65 | 23 | 5.82 | 1.17 | 0.979 |
| Example 10 | 3 | 2.0 | 56 | 25 | 5.49 | 1.15 | 0.983 |
| Example 11 | 8 | 10.0 | 60 | 20 | 5.20 | 1.22 | 0.980 |
| Example 12 | 4 | 4.0 | 45 | 17 | 4.15 | 1.19 | 0.970 |
| Example 13 | 6 | 6.0 | 65 | 22 | 5.81 | 1.17 | 0.979 |
| Example 14 | 5 | 4.5 | 55 | 25 | 5.50 | 1.15 | 0.983 |
| Example 15 | 7 | 7.5 | 60 | 23 | 5.56 | 1.22 | 0.980 |
| Example 16 | 6 | 6.0 | 47 | 19 | 4.23 | 1.19 | 0.970 |
| Example 17 | 3 | 2.0 | 58 | 21 | 7.00 | 1.20 | 0.983 |
| Example 18 | 5 | 4.5 | 78 | 18 | 6.33 | 1.15 | 0.980 |
| Comparative Example 1 | 1 | 0.8 | 65 | 22 | 6.99 | 1.17 | 0.979 |
| Comparative Example 2 | 2 | 1.8 | 55 | 25 | 5.64 | 1.15 | 0.983 |
| Comparative Example 3 | 9 | 10.2 | 62 | 23 | 5.51 | 1.22 | 0.980 |
| Comparative Example 4 | 1 | 0.8 | 43 | 17 | 4.15 | 1.19 | 0.970 |

(3)

| | Quality | | | |
|---|---|---|---|---|
| | Regulation Member Anchorage | Filming | Solid Image Followability | Photoconductor Filming |
| Example 1 | Good | Good | Good | Good |
| Example 2 | Good | Good | Good | Excellent |
| Example 3 | Excellent | Excellent | Excellent | Excellent |
| Example 4 | Excellent | Good | Good | Excellent |
| Example 5 | Good | Good | Good | Excellent |
| Example 6 | Excellent | Good | Excellent | Excellent |
| Example 7 | Good | Excellent | Excellent | Excellent |
| Example 8 | Excellent | Good | Excellent | Excellent |
| Example 9 | Excellent | Good | Excellent | Excellent |
| Example 10 | Excellent | Good | Excellent | Good |
| Example 11 | Excellent | Good | Good | Excellent |
| Example 12 | Excellent | Excellent | Excellent | Excellent |
| Example 13 | Excellent | Excellent | Excellent | Excellent |
| Example 14 | Excellent | Excellent | Excellent | Excellent |
| Example 15 | Good | Excellent | Excellent | Excellent |
| Example 16 | Excellent | Excellent | Excellent | Excellent |
| Example 17 | Excellent | Good | Good | Good |
| Example 18 | Excellent | Excellent | Excellent | Excellent |
| Comparative Example 1 | Good | Poor | Poor | Poor |
| Comparative Example 2 | Poor | Good | Good | Poor |
| Comparative Example 3 | Poor | Good | Good | Excellent |
| Comparative Example 4 | Good | Poor | Poor | Poor |

Having now fully described the invention, it will be apparent to one of ordinary skill in the art that many changes and modifications can be made thereto without departing from the spirit and scope of the invention as set forth therein.

What is claimed is:

1. A developing roller, comprising:

a conductive axis body;

a conductive elastic layer overlying the conductive axis body; and a toner bearing layer overlying the conductive elastic layer and having a surface dispersed with particles having an average particle diameter of from 11 nm to 40 nm, wherein a rotary torque of the developing roller is from 2.5 N to 3.5 N when the developing roller is rotated at 180 rpm, and wherein the toner bearing layer includes concavities and convexities adjacent to each other having gaps therebetween of from 1 to 3 μm.

2. The developing roller of claim 1, wherein the toner bearing layer comprises a polymer formed of a polyisocyanate prepolymer and an alternating copolymer of fluoroethylene and vinyl ether.

3. The developing roller of claim 1, wherein the surface of the toner bearing layer has a roughness skewness Rsk in the longitudinal direction of from −0.6 to −0.3.

4. The developing roller of claim 1, wherein the particles having an average particle diameter of from 11 nm to 40 nm are hydrophobized silica, titanium oxide or aluminum oxide.

5. A toner used for the developing roller according claim 1, the toner comprising:

a core particle comprising a binder resin, a colorant and a release agent; and a fine resin particle adhering to the surface of the core particle, wherein an amount of the release agent abstracted from 1.0 g of the toner with n-hexane is from 10 mg to 26 mg.

6. An image forming apparatus, comprising:

a latent image bearer to bear a latent image;

a charger to uniformly charge the surface of the latent image bearer;

an irradiator to irradiate the surface of the latent image bearer according to image data to form an electrostatic latent image on the surface thereof;

the developing roller according claim 1 to feed a toner to the electrostatic latent image to form a visible image on the surface of the latent image bearer;

a transferer to transfer the visible image to a transfer body; and a fixer to fix the visible image on the transfer body.

7. The image forming apparatus of claim 6, further comprising a cleaner comprising a cleaning blade to clean a toner adhering to the latent image bearer.

8. The image forming apparatus of claim 7, wherein the cleaning blade comprises a strip-shaped elastic blade including a tip ridgeline contacting the surface of the latent image bearer and a surface facing the latent image bearer, and wherein the elastic blade has a Martens hardness of from 2.0 $N/mm^2$ to 10.0 $N/mm^2$, the Martens hardness measured by pushing a Vickers quadrangular pyramid penetrator of a hardness meter into a position on the surface facing the latent image bearer of the elastic blade by a depth of 5 μm, the position being 20 μm downstream from the tip ridgeline relative to the rotational direction of the latent image bearer.

9. The image forming apparatus of claim 7, wherein the elastic blade has a Martens hardness of from 4.0 $N/mm^2$ to 6.0 $N/mm^2$.

10. A developing roller, comprising:

a conductive axis body;

a conductive elastic layer overlying the conductive axis body; and a toner bearing layer overlying the conductive elastic layer and having a surface dispersed with particles having an average particle diameter of from 11 nm to 40 nm, wherein a rotary torque of the developing roller is proportional to a force of 2.5 N to 3.5 N detected when the developing roller is rotated at 180 rpm, and wherein the toner bearing layer includes concavities and convexities adjacent to each other having gaps therebetween of from 1 to 3 μm.

* * * * *